US011992129B2

(12) United States Patent
Peterson et al.

(10) Patent No.: US 11,992,129 B2
(45) Date of Patent: May 28, 2024

(54) BED WITH MAGNETIC COUPLERS

(71) Applicant: Sleep Number Corporation, Minneapolis, MN (US)

(72) Inventors: Craig Peterson, Oak Grove, MN (US); Dominic Grey, Brooklyn Park, MN (US); Jeff Ingham, Minneapolis, MN (US); Anthony John Shakal, Minneapolis, MN (US)

(73) Assignee: Sleep Number Corporation, Minneapolis, MN (US)

( * ) Notice: Subject to any disclaimer, the term of this patent is extended or adjusted under 35 U.S.C. 154(b) by 0 days.

(21) Appl. No.: 17/495,296

(22) Filed: Oct. 6, 2021

(65) Prior Publication Data

US 2022/0273118 A1 Sep. 1, 2022

Related U.S. Application Data

(63) Continuation of application No. 15/807,002, filed on Nov. 8, 2017, now Pat. No. 11,140,999, which is a continuation-in-part of application No. 15/347,572, filed on Nov. 9, 2016, now abandoned.

(51) Int. Cl.

| | |
|---|---|
| ***A47C 31/00*** | (2006.01) |
| ***A47C 19/02*** | (2006.01) |
| ***A47C 20/04*** | (2006.01) |
| ***A47C 20/08*** | (2006.01) |
| ***A47C 27/08*** | (2006.01) |
| ***A47C 27/10*** | (2006.01) |

(52) U.S. Cl.

CPC ..... *A47C 31/003* (2013.01); *A47C 19/025* (2013.01); *A47C 20/04* (2013.01); *A47C 20/08* (2013.01); *A47C 27/083* (2013.01); *A47C 27/10* (2013.01); *A47C 31/008* (2013.01)

(58) Field of Classification Search

CPC ..... A47C 20/04–048; A47C 19/028; A47C 19/025; A47C 20/08; A47C 31/003

See application file for complete search history.

(56) References Cited

U.S. PATENT DOCUMENTS

| | | | |
|---|---|---|---|
| 3,107,408 | A | 10/1963 | Huelster |
| 4,480,361 | A | 11/1984 | Morita |
| 4,644,597 | A | 2/1987 | Walker |

(Continued)

FOREIGN PATENT DOCUMENTS

| | | |
|---|---|---|
| DE | 202008000249 | 3/2008 |

OTHER PUBLICATIONS

U.S. Appl. No. 09/471,592, filed Dec. 23, 1999, Shafer.

(Continued)

*Primary Examiner* — David R Hare
*Assistant Examiner* — Amanda L Bailey
(74) *Attorney, Agent, or Firm* — Fish & Richardson P.C.

(57) ABSTRACT

A magnetic coupler for attaching a mattress to a bed foundation includes a magnet assembly, a target assembly, and a shunt. The magnet assembly includes a housing and a magnet, wherein the housing is configured to couple the magnet to the mattress. The target assembly is configured to couple a target to the foundation. The shunt is disposed within the housing of the magnet assembly or in the mattress. The magnet assembly and the target assembly are releasably attached when the magnet is magnetically coupled to the target.

14 Claims, 11 Drawing Sheets

(56) References Cited

U.S. PATENT DOCUMENTS 4,766,628 A 8/1988 Greer et al.
4,779,314 A 10/1988 Aoki
4,788,729 A 12/1988 Greer et al.
D300,194 S 3/1989 Walker
4,829,616 A 5/1989 Walker
4,890,344 A 1/1990 Walker
4,897,890 A 2/1990 Walker
4,908,895 A 3/1990 Walker
D313,973 S 1/1991 Walker
4,989,299 A 2/1991 Morita
4,991,244 A 2/1991 Walker
5,103,513 A 4/1992 King
5,144,706 A 9/1992 Walker et al.
5,170,522 A 12/1992 Walker
5,195,197 A 3/1993 Gutierrez et al.
D368,475 S 4/1996 Scott
5,509,154 A 4/1996 Shafer et al.
5,560,089 A 10/1996 Morita
5,564,140 A 10/1996 Shoenhair et al.
5,642,546 A 7/1997 Shoenhair
5,652,484 A 7/1997 Shafer et al.
5,682,653 A 11/1997 Berglof
5,765,246 A 6/1998 Shoenhair
5,815,865 A 10/1998 Washburn
5,903,941 A 5/1999 Shafer et al.
5,904,172 A 5/1999 Gifft et al.
6,037,723 A 3/2000 Shafer et al.
6,088,858 A 7/2000 Juster et al.
6,108,844 A 8/2000 Kraft et al.
6,161,231 A 12/2000 Kraft et al.
6,202,239 B1 3/2001 Ward et al.
6,286,166 B1 9/2001 Henley et al.
6,286,736 B1 9/2001 Angus
6,311,348 B1 11/2001 Luff
6,397,419 B1 6/2002 Mechache
6,483,264 B1 11/2002 Shafer et al.
6,626,820 B1 9/2003 Ardizzone
6,686,711 B2 2/2004 Rose et al.
6,708,357 B2 3/2004 Gaboury et al.
6,763,541 B2 7/2004 Mahoney et al.
6,804,848 B1 10/2004 Rose
6,832,397 B2 12/2004 Gaboury
D502,929 S 3/2005 Copeland et al.
6,883,191 B2 5/2005 Gaboury et al.
7,197,780 B2 4/2007 Petric
7,222,377 B2 5/2007 Kramer
7,389,554 B1 6/2008 Rose
7,523,515 B2 4/2009 Allen et al.
7,843,296 B2 11/2010 Fullerton et al.
7,865,988 B2 1/2011 Koughan et al.
8,069,512 B2 12/2011 Rawls-Meehan
8,282,452 B2 10/2012 Grigsby et al.
8,336,369 B2 12/2012 Mahoney
8,375,488 B2 2/2013 Rawls-Meehan
8,444,558 B2 5/2013 Young et al.
8,505,174 B2 8/2013 Fildan
D691,118 S 10/2013 Ingham et al.
D697,874 S 1/2014 Stusynski et al.
D698,338 S 1/2014 Ingham
8,646,130 B2 2/2014 Alzoubi et al.
D701,536 S 3/2014 Sakal
8,672,853 B2 3/2014 Young
8,769,747 B2 7/2014 Mahoney et al.
8,893,339 B2 11/2014 Fleury et al.
8,931,329 B2 1/2015 Mahoney et al.
8,966,689 B2 3/2015 McGuire et al.
8,973,183 B1 3/2015 Palashewski et al.
8,984,687 B2 3/2015 Stusynski et al.
D728,254 S 5/2015 Blazar et al.
D737,250 S 8/2015 Ingham et al.
9,314,118 B2 4/2016 Blazar et al.
9,578,941 B2 2/2017 MacLachlan et al.
9,730,524 B2 8/2017 Chen et al.
9,737,154 B2 8/2017 Mahoney et al.
D809,843 S 2/2018 Keeley et al.
D812,393 S 3/2018 Karschnik et al.
9,924,813 B1 3/2018 Basten et al.
10,143,312 B2 12/2018 Brosnan et al.
10,149,549 B2 12/2018 Erko et al.
10,173,292 B2 * 1/2019 Fullerton ..... B23P 15/001
D840,732 S 2/2019 Peterson et al.
10,194,753 B2 2/2019 Fleury et al.
10,285,508 B2 5/2019 Rose et al.
10,342,358 B1 7/2019 Palashewski et al.
D857,433 S 8/2019 Kiekhoefer et al.
10,531,745 B2 1/2020 McGuire et al.
10,539,170 B2 1/2020 Peterson et al.
10,575,654 B2 3/2020 Shakal
10,677,232 B2 6/2020 Shakal et al.
10,729,253 B1 8/2020 Gaunt
10,765,224 B2 9/2020 Chen et al.
10,813,470 B2 10/2020 Mahoney et al.
10,827,846 B2 11/2020 Karschnik et al.
10,888,173 B2 1/2021 Shakal et al.
10,993,546 B2 5/2021 Shakal et al.
11,001,447 B2 5/2021 Shutes et al.
11,085,479 B2 8/2021 Griffith et al.
11,096,502 B2 8/2021 Rose et al.
D932,808 S 10/2021 Keeley
2008/0077020 A1 3/2008 Young et al.
2011/0144455 A1 6/2011 Young et al.
2013/0042412 A1 * 2/2013 Shih ..... A47C 31/003 5/693
2014/0182060 A1 * 7/2014 Mikkelsen ..... A47C 21/026 5/400
2014/0182061 A1 7/2014 Zaiss
2014/0250597 A1 9/2014 Chen et al.
2014/0257571 A1 9/2014 Chen et al.
2014/0259417 A1 9/2014 Nunn et al.
2014/0259418 A1 9/2014 Nunn et al.
2014/0259431 A1 9/2014 Fleury
2014/0259433 A1 9/2014 Nunn et al.
2014/0259434 A1 9/2014 Nunn et al.
2014/0277611 A1 9/2014 Nunn et al.
2014/0277778 A1 9/2014 Nunn et al.
2014/0277822 A1 9/2014 Nunn et al.
2015/0007393 A1 1/2015 Palashewski
2015/0025327 A1 1/2015 Young et al.
2015/0026896 A1 1/2015 Fleury et al.
2015/0157137 A1 6/2015 Nunn et al.
2015/0157519 A1 6/2015 Stusynski et al.
2015/0182033 A1 7/2015 Brosnan et al.
2015/0182397 A1 7/2015 Palashewski et al.
2015/0182399 A1 7/2015 Palashewski et al.
2015/0182418 A1 7/2015 Zaiss
2015/0290059 A1 10/2015 Brosnan et al.
2015/0366366 A1 12/2015 Zaiss et al.
2015/0374137 A1 12/2015 Mahoney et al.
2016/0100696 A1 4/2016 Palashewski et al.
2016/0150890 A1 * 6/2016 Heeke ..... A47C 21/06 5/613
2016/0206489 A1 * 7/2016 Rawls-Meehan .... A47C 21/026
2017/0202360 A1 * 7/2017 Sherman ..... A47C 20/04
2017/0325592 A1 * 11/2017 Suh ..... A47C 31/00
2019/0082855 A1 3/2019 Brosnan et al.
2019/0125089 A1 * 5/2019 Aramli ..... A47C 19/021
2020/0187667 A1 6/2020 Shakal
2020/0359805 A1 11/2020 Brosnan et al.
2020/0375369 A1 12/2020 Negus et al.
2020/0400135 A1 12/2020 Shakal et al.
2021/0037986 A1 2/2021 Gaunt
2021/0145183 A1 5/2021 Negus et al.
2021/0145185 A1 5/2021 Negus et al.

OTHER PUBLICATIONS

U.S. Appl. No. 14/594,843, filed Jan. 12, 2015, Rose et al.
U.S. Appl. No. 17/006,388, filed Aug. 28, 2020, McGuire et al.
U.S. Appl. No. 17/078,558, filed Oct. 23, 2020, Hilden et al.
U.S. Appl. No. 17/145,645, filed Jan. 11, 2021, Shakal.
U.S. Appl. No. 17/224,936, filed Apr. 7, 2021, Shakal et al.
U.S. Appl. No. 17/374,369, filed Jul. 13, 2021, Griffith et al.
U.S. Appl. No. 17/408,661, filed Aug. 23, 2021, Rose et al.

(56) References Cited

OTHER PUBLICATIONS

U.S. Appl. No. 17/410,424, filed Aug. 24, 2021, Doffing et al.
U.S. Appl. No. 17/495,296, filed Oct. 6, 2021, Peterson et al.
U.S. Appl. No. 29/719,090, filed Dec. 31, 2019, Kirk et al.
U.S. Appl. No. 29/807,154, filed Sep. 9, 2021, Negus.
International Preliminary Report on Patentability in Application No. PCT/US2017/060595, dated May 14, 2019, 6 pages.
International Search Report and Written Opinion in International Application No. PCT/US2017/060595, dated Dec. 15, 2017, 11 pages.
Rudnev, Valery Loveless, Don Cook, Raymond L. (2017). Handbook of Induction Heating (2nd Edition) -4.7.3 Magnetic Flux Concentrators, (pp. 379). CRC Press. Retrieved from https://app.knovel.com/hotlink/pdf/id:kt011 MM7YA/handbook-induction-heating/magnetic-flux-concentrators (Year: 2017).

* cited by examiner

BED WITH MAGNETIC COUPLERS

CROSS-REFERENCE TO RELATED APPLICATIONS

This application is a continuation of application U.S. application Ser. No. 15/807,002, filed on Nov. 8, 2017, which is a continuation-in-part application of and claims priority to U.S. application Ser. No. 15/347,572, filed on Nov. 9, 2016. This disclosure of the prior application is considered part of and is incorporated by reference in the disclosure of this application.

TECHNICAL FIELD

This invention relates to beds, and more particularly to beds with magnetic couplers.

BACKGROUND

People have traditionally used beds that come in many shapes, sizes, and styles. Such beds can range from extremely simple designs to rather complex designs that include a variety of features. For example, some beds include mattresses containing foam, inner-springs, and/or fluid-inflatable bladders. Furthermore, the mattresses may be supported by a frame, box spring, adjustable foundation, or a non-adjustable foundation.

The mattress of some bed systems can be placed on a frame without being secured to the frame. The mattress may, however, eventually slide off the frame or bunch together on a side that abuts a wall, a head frame, or a foot frame. In some bed systems, the mattress can be secured to the frame with screws and bolts. Manipulating screws and bolts, however, can be cumbersome when securing the mattress onto the frame or when removing the mattress from the frame, thus increasing the difficulty of installing and using such bed systems.

SUMMARY

Some embodiments of a bed system provided herein can include one or more of the features and functions disclosed herein. In particular, the bed system can include a mattress, a bed foundation, and one or more magnetic couplers to attach the mattress to the foundation. Some embodiments of the magnetic coupler provided herein can include a two-component assembly that includes a first portion attachable to a portion of the mattress, and a second portion that is attachable to a portion of the foundation. The mattress can be attached and held in proper position on top of the foundation using the one or more magnetic couplers provided herein by positioning the first portion of each coupler to the second portion thereof. The magnetic couplers provided herein provide a quick, simple, and reliable way to attach and secure the mattress to the foundation as well as to detach the mattress from the foundation, when desired.

In some aspects, a magnetic coupler for attaching a mattress to a bed foundation includes a magnet assembly, a target assembly, and a shunt disposed within the housing of the magnet assembly or in the mattress. The magnet assembly can comprise a housing and a magnet, wherein the housing is configured to couple the magnet to a mattress. The target assembly can be configured to couple a target to a foundation. The magnet assembly and the target assembly can be releasably attached when the magnet is magnetically coupled to the target.

In some cases, the magnet can be a permanent magnet. In some cases, the permanent magnet can include neodymium iron boron (NdFeB), samarium cobalt (SmCo), alnico, ceramic magnets, or ferrite magnets. In some cases, the target, the shunt, or both, can include iron, steel, nickel, cobalt, or alloys or combinations thereof. In some cases, the shunt can be configured to shield at least a portion of the magnetic field radiating towards the mattress. In some cases, the magnet assembly and the target assembly can be released from one another when the tensile force applied to either the magnet assembly or the target assembly is greater than a predetermined threshold force value ranging from about 50 lbf to about 150 lbf. In some cases, the housing can comprise a top housing and a bottom housing, wherein the top housing and bottom housing are configured to mate together to form a shell defining an internal cavity. In some cases, the magnet assembly can further comprise a clamping disc shaped to mate with the top housing and configured for gripping a portion of the mattress when mated with the top housing. In some cases, the clamping disc can include a top surface defined by a plurality of teeth and wherein the teeth of the clamping disc engage with the mating teeth of the top housing to grip a fabric material of the mattress. In some cases, the clamping disc can be disposed within the internal cavity. In some cases, the shunt can be disposed within the internal cavity. In some cases, the magnet can include an array of discrete magnets that are arranged in an alternating polarity pattern. In some cases, the magnet assembly can comprise a received portion and the target assembly comprises a receiving portion, the received portion configured to engage with the receiving portion when the magnet assembly is magnetically coupled to the target assembly, and wherein the received portion has a surface area that is smaller than the surface area of the receiving portion. In some cases, a ratio of a diameter of the receiving portion to a diameter of a received portion can be between 1.5:1 to 3:1.

In some cases, a bed system includes a foundation, a mattress positioned on the foundation, one or more magnetic couplers, and a shunt disposed within the housing of the magnet assembly or in the mattress. Each magnetic coupler includes a magnet assembly comprising a housing and a magnet, wherein the housing is configured to couple the magnet to the mattress. Each magnetic coupler can include a target assembly configured to couple a target to the foundation. The magnet assembly and the target assembly can be releasably attached when the magnet is magnetically coupled to the target.

In some cases, the bed system can be an air bed system, wherein the mattress comprises an inflatable air chamber, wherein the foundation comprises an adjustable foundation configured for raising both the head and feet of the mattress when the adjustable foundation is actuated, and wherein the one or more magnetic couplers retains the mattress on the adjustable foundation during articulation of the adjustable foundation. In some cases, the foundation can be an articulable foundation. In some cases, the mattress can comprise a fabric layer and a support structure positioned inside of and fully encapsulated by the fabric layer, and wherein the magnet assembly is coupled to the fabric layer. In some cases, the magnet assembly can comprise means for engaging with the target assembly.

In some aspects, a bed system includes an adjustable foundation, a mattress positioned on the foundation, and a plurality of means for releasably coupling the mattress to the foundation so as to hold the mattress in place on the foundation when the foundation is raised and lowered. The plurality of means for releasably coupling the mattress can comprise one or more magnetic couplers. Each magnetic coupler can include a magnet assembly comprising a top housing, a bottom housing, and a housing fastener for coupling the top and bottom housing together, the top housing having a top surface, a bottom surface, and sloped top lateral walls, the bottom surface being defined by the sloped lateral walls, a plurality of teeth, and a central flange, the bottom housing including a top surface, a bottom surface, and sloped bottom lateral walls, the bottom surface includes an outwardly projecting bead forming a flange that extends interior walls defining a central hole of the bottom housing, wherein the central hole of the bottom housing is configured to receive a magnet. Each magnetic coupler can include a target assembly comprising an annular cup, a target, and one or more mechanical fasteners for coupling the target to the annular cup.

These and other embodiments can each optionally include one or more of the features described below. Particular embodiments of the subject matter described in this specification can be implemented so as to realize none, one or more of the advantages described below.

The details of one or more embodiments of the invention are set forth in the accompanying drawings and the description below. Other features, objects, and advantages of the invention will be apparent from the description and drawings, and from the claims.

DETAILED DESCRIPTION

Magnetic connectors for bed systems, such as for inflatable air beds, can be used to attach a mattress (e.g., an air mattress) to a bed foundation at bed assembly. The magnetic couplers provided herein can include a two-component assembly that includes a first portion that is attachable to a portion of the mattress (e.g., ticking, scrim, or fabric layer), and a second portion that is attachable to the bed foundation. The mattress can be held in proper position in a quick and simple manner with one or more magnetic couplers by positioning the first portion of each coupler to the second portion thereof. The magnetic couplers provided herein can be desirable for a bed system to provide a quick, simple, and reliable way to attach and secure the mattress to the bed foundation as well as detach the mattress from the foundation, when desired.

Figure 1:
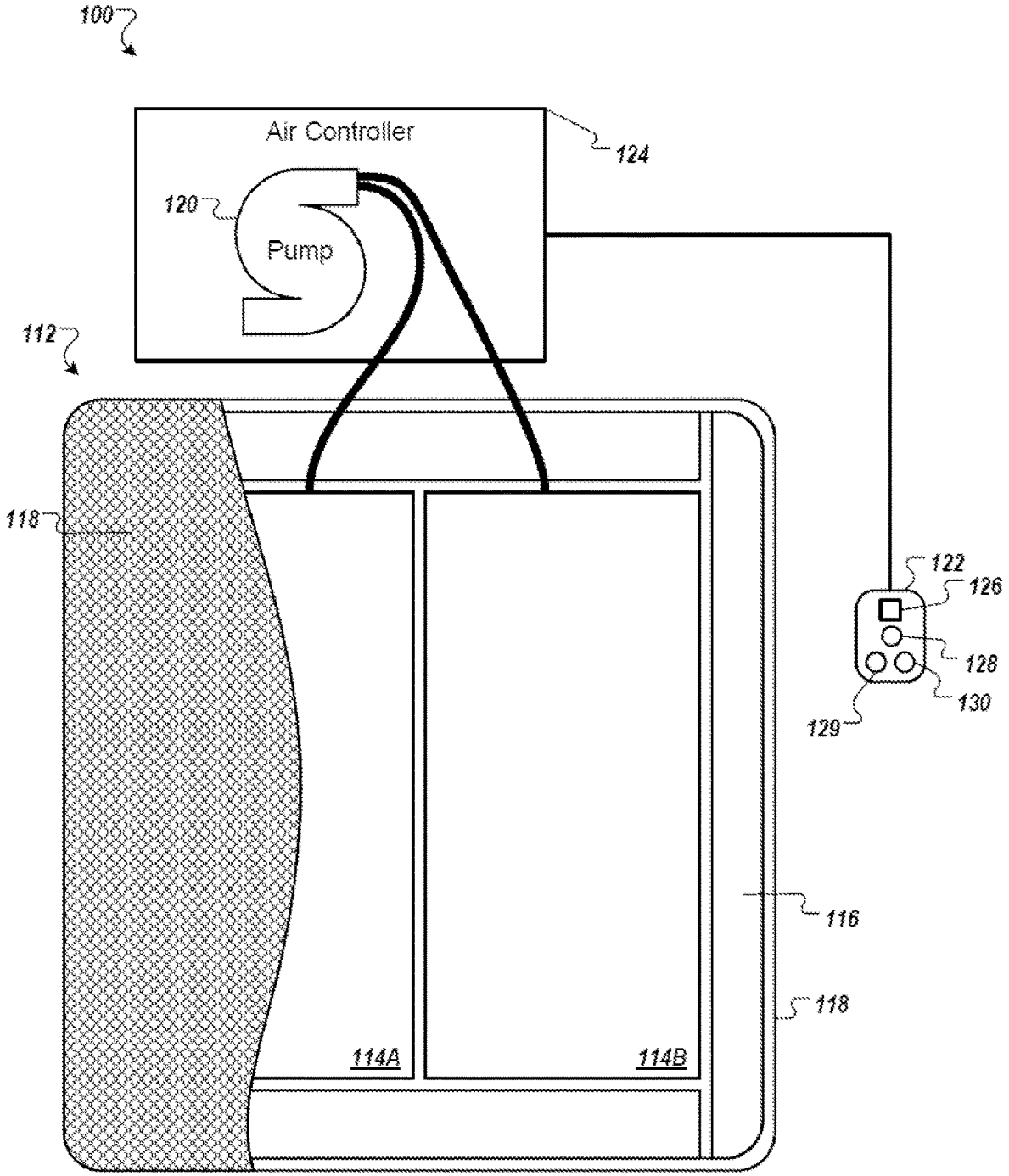
FIG. 1 shows a schematic top view of an example bed system with magnetic couplers.

FIG. 1 shows an example bed system 100 that includes a mattress 112. The mattress 112 can be an air bed system that includes at least one air chamber 114 surrounded by a resilient border 116 and encapsulated by bed ticking 118. The resilient border 116 can comprise any suitable material, such as foam. In some cases, the bed ticking 118 can be made of a fabric material, such as a scrim. In some cases, the bed ticking 118 can be attached with one or more magnetic couplers 119 for coupling the bed to a bed foundation (not shown in FIG. 1; see the foundation 204 shown in FIGS. 2A and 2B). The magnetic couplers 119 can be connected to the bed ticking 118 and/or another portion of the mattress 112 without requiring the magnetic couplers 119 to connect directly to the air chamber 114.

As illustrated in FIG. 1, the mattress 112 can be a two chamber design having first and second fluid chambers, such as a first air chamber 114A and a second air chamber 114B. In alternative embodiments, the mattress 112 can include chambers for use with fluids other than air that are suitable for the application. In some embodiments, such as single beds or kids' beds, the mattress 112 can include a single air chamber 114A or 114B or multiple air chambers 114A and 114B. First and second air chambers 114A and 114B can be in fluid communication with a pump 120. The pump 120 can be in electrical communication with a remote control 122 via control box 124. The control box 124 can include a wired or wireless communications interface for communicating with one or more devices, including the remote control 122. The control box 124 can be configured to operate the pump 120 to cause increases and decreases in the fluid pressure of the first and second air chambers 114A and 114B based upon commands input by a user using the remote control 122. In some implementations, the control box 124 is integrated into a housing of the pump 120. In other implementations, the control box 124 can be separate from the pump 120.

The remote control 122 can include a display 126, an output selecting mechanism 128, a pressure increase button 129, and a pressure decrease button 130. The output selecting mechanism 128 can allow the user to switch air flow generated by the pump 120 between the first and second air chambers 114A and 114B, thus enabling control of multiple air chambers with a single remote control 122 and a single pump 120. For example, the output selecting mechanism 128 can by a physical control (e.g., switch or button) or an input control displayed on display 126. Alternatively, separate remote control units can be provided for each air chamber and can each include the ability to control multiple air chambers. Pressure increase and decrease buttons 129 and 130 can allow a user to increase or decrease the pressure, respectively, in the air chamber selected with the output selecting mechanism 128. Adjusting the pressure within the selected air chamber can cause a corresponding adjustment to the firmness of the respective air chamber. In some embodiments, the remote control 122 can be omitted or modified as appropriate for an application. For example, in some embodiments the bed system 100 can be controlled by a computer, tablet, smart phone, or other device in wired or wireless communication with the bed system 100. In some embodiments, the remote control 122 can also control operation of an articulable foundation that supports the mattress 112.

Figure 2A:
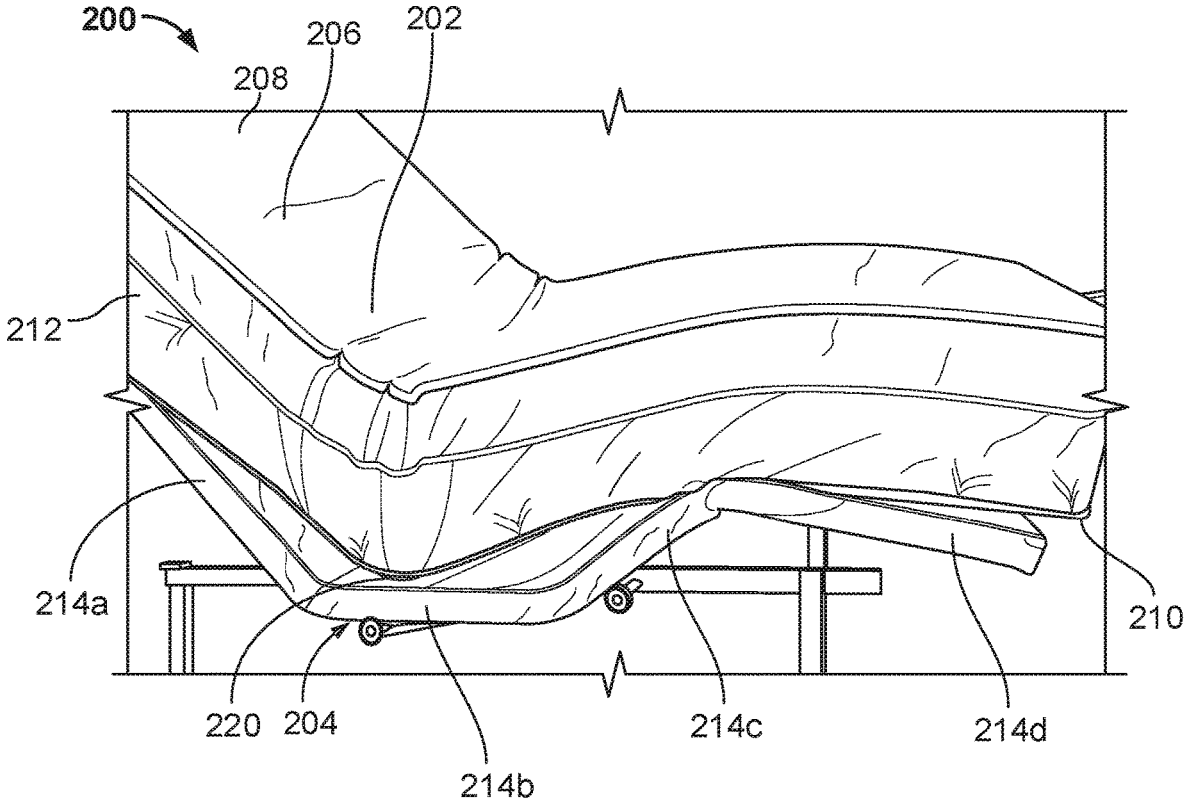
FIG. 2A shows a side view of an alternative example bed system with magnetic couplers.

FIG. 2A shows another example bed system 200 that includes a bed mattress 202 and an articulable foundation 204. The mattress 202 can be positioned on top of the foundation 204 to provide a comfortable, supportive sleep area for the user (not shown). The mattress 202 can include a support structure (not shown in FIG. 2A; see e.g., the air chamber 114 surrounded by a resilient border 116 as shown in FIG. 1) encapsulated by an outer fabric layer 206. The mattress 202 can include a top 208, a bottom 210, and sides 212 extending between the top 208 and the bottom 210. The foundation 204 can include one or more sections 214*a*, 214*b*, 214*c*, 214*d*. One or more of the sections 214*a*, 214*b*, 214*c*, 214*d* can be articulable sections for positioning various sections of the mattress 202 into various spatial configurations, as desired by the user. The foundation 204 can move into the various spatial configurations by changing the heights and adjusting the angles of one or more of its articulable sections 214*a*, 214*b*, 214*c*, 214*d* relative to one another.

As shown in FIG. 2A, the bottom 210 of the mattress 202 can be coupled to the foundation 204 by one or more magnet couplers 220 such that the mattress 202 does not slide along a top surface of the foundation 204 when the articulable sections 214*a*, 214*b*, 214*c*, 214*d* move the mattress 202. This allows the mattress 202 to remain aligned with the foundation 204 when articulated such that the mattress 202 does not slide out of alignment with the foundation, slide off the foundation 204, or bunch together against an adjacent structure (not shown), such as a wall or a head or foot frame. The magnet coupler 220 can thus provide an easy method of attaching or detaching the mattress 202 to the foundation 204 since magnetic coupling can be established by simply placing coupleable portions of the magnetic coupler 220, which are separately attached to the mattress 202 and the foundation 204, into close proximity to one another.

Figure 2B:
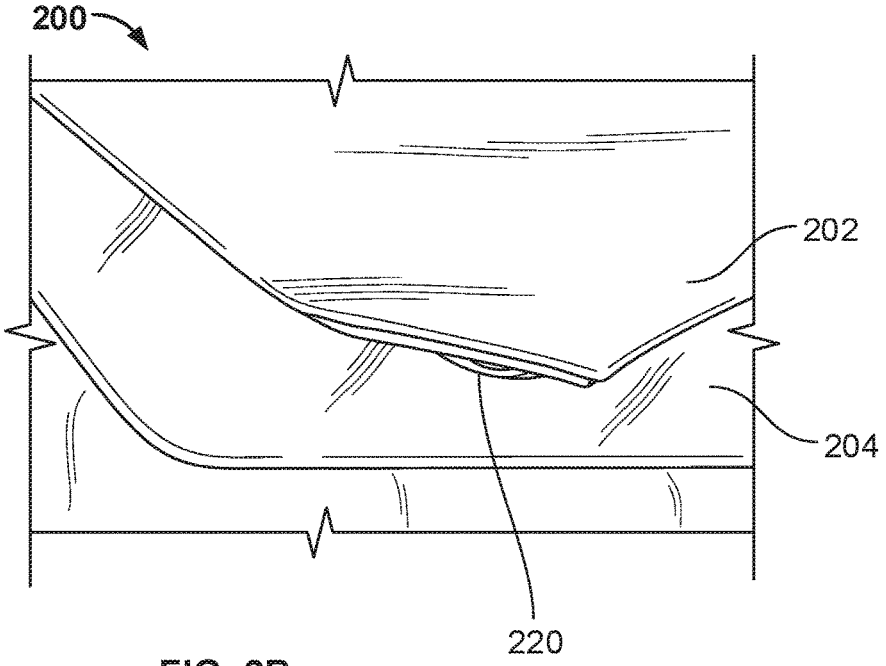
FIG. 2B is a magnified illustration of the magnetic coupler of FIG. 2A, according to some embodiments.

FIG. 2B shows a magnified illustration of the magnet coupler 220 of FIG. 2A coupling the mattress 202 to the foundation 204. As shown, the magnetic coupler 220 can be attached to a portion of the mattress 202 (e.g., the outer fabric layer 206) and a portion of the foundation 204. Respective parts of the magnet coupler 220 can be attached to portions of the mattress 202 and foundation 204 by one or more mechanical fasteners (e.g., a screw, a nut, a bolt, a staple, a hook, or the like), which will be discussed in later sections. As shown in FIG. 2B, the outer fabric layer 206 can be elastic so as to at least partially stretch when the magnet coupler 220 is in tension.

Figure 3:
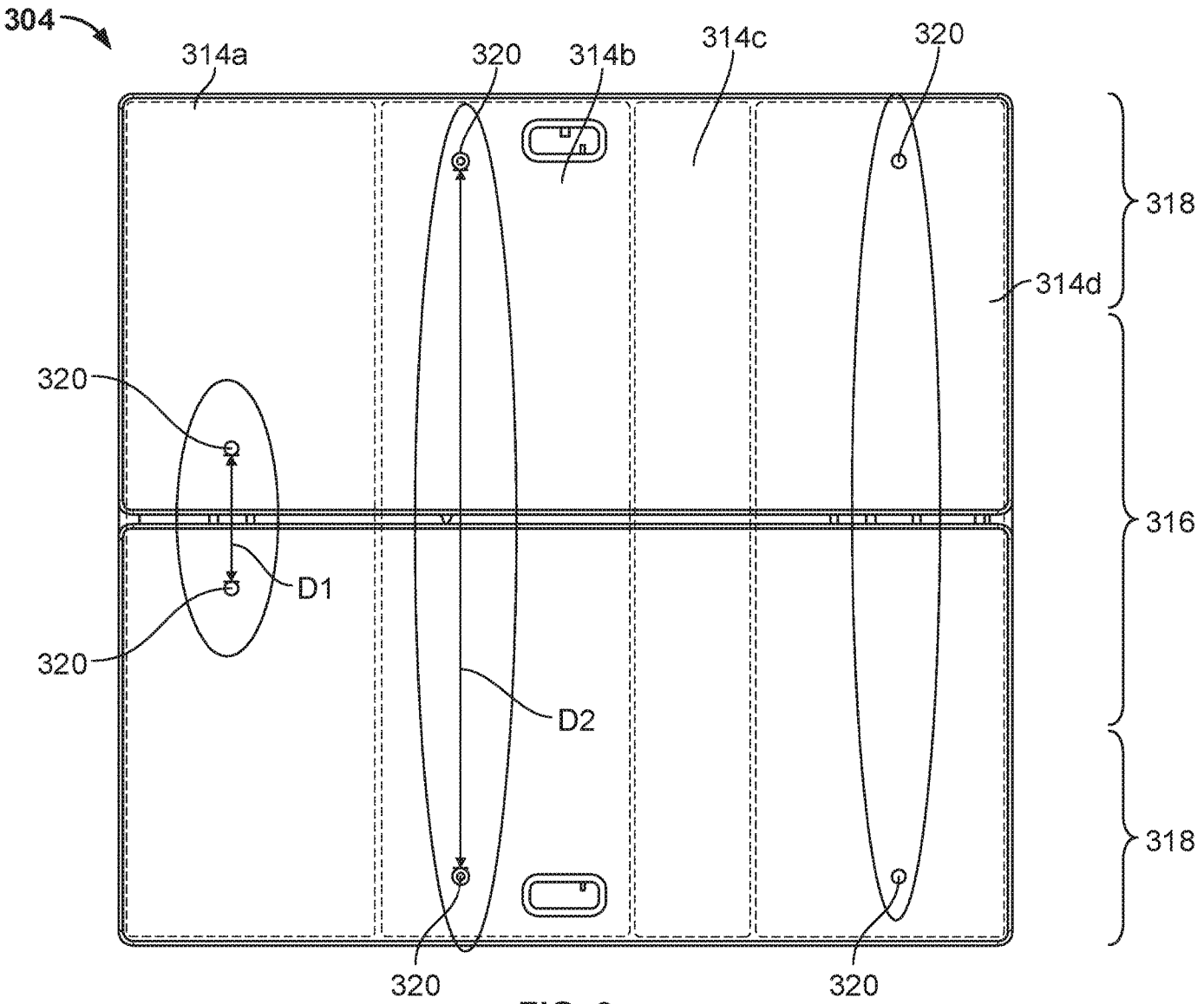
FIG. 3 is a top view of an example bed foundation with magnetic couplers.

FIG. 3 shows a top view of an example foundation 304 including six locations for attaching a magnetic coupler 320. The depicted foundation 304 includes four sections: a head section 314*a*, an upper midsection 314*b*, a lower midsection 314*c*, and a foot section 314*d*. The foundation 304 can be sized and shaped for any mattress size, for example, a king, queen, twin, twin XL sized mattress, or a custom-sized mattress. The magnetic couplers 320 can be positioned at one or more locations along a top surface of the foundation 304 such that magnetic couplers 320 secure the mattress 302 to the foundation 304. In some cases, the foundation 304 can accommodate any number of magnetic couplers 320 (e.g., two, three, four, five, six, eight, ten, twelve, fourteen, sixteen, eighteen, twenty, thirty, forty, fifty, or greater than fifty). In some cases, the magnetic couplers 320 can be positioned at locations symmetrically along the foundation 304 to increase proper securement of the mattress, and, in some cases, to reduce or minimize the amount of shear force exerted on the mattress 302 that prevents possible detachment of the mattress 302 from the foundation 304. Alternatively, in some cases, the magnetic couplers 320 can be asymmetrically positioned along the surface of the foundation 304 to allow for easier movement and conformance of the mattress 302 when the foundation 304 is articulated. The depicted foundation 304 can be compatible and magnetically coupleable with a mattress (not shown in FIG. 3) having a complementary set of magnetic couplers 320 attached along its bottom surface.

As shown in FIG. 3, the head section 314*a* of the foundation 304 includes one set of two symmetrically positioned magnetic couplers 320, the upper midsection 314*b* of the foundation 304 includes one set of two symmetrically positioned magnetic couplers 320, and the foot section 314*d* includes a set of two symmetrically positioned magnetic couplers 320. In some cases, some of the articulable sections of the foundation 304 may not include magnetic couplers 320 (e.g., the lower midsection 314*c*). In some cases, any one section of the foundation 304 can include one or more sets of magnetic couplers. In some cases, any one section of the foundation 304 can include a single magnet or a set of magnets, either symmetrically or asymmetrically positioned. In FIG. 3, the magnetic couplers 320 at the head section 314*a* are located near a central portion 316 of the foundation 304. The magnetic couplers 320 at the upper midsection is located in a peripheral portion 318 of the foundation 304. The magnetic couplers 320 at the foot section 314*d* are positioned at peripheral portions 316, 318 of the foundation 304. The magnetic couplers 320 at the head section 314*a* are spaced apart by a second lateral distance "D1". The magnetic couplers 320 located in the upper midsection 314*b* are spaced apart by a first lateral distance "D2". In some cases, the pair of magnetic couplers 320 at the head sections 314*a* are positioned closer to one another than the pair of magnetic couplers 320 at the upper midsection 314*b* (D1<D2). Such a configuration may be desirable in an articulable bed system having separately articulable head sections, such as an articulable bed system that is split with two separately articulable mattress or an articulable bed system with a split head section and a joined foot section. In some cases, the magnetic couplers 320 may be positioned on the foundation 304 such that the couplers 320 can be easily accessed during assembly and/or disassembly of the bed system.

FIGS. 4A-4D show an example magnetic coupler 420 in an assembled state. The magnetic coupler 420 can be coupled to a mattress 402, such as an outer fabric layer of the mattress, and a foundation 404 of a bed system (e.g., the bed system 100 of FIG. 1). The magnetic coupler 420 can include two major portions: a first portion 430 (see FIGS. 4A-4C) of the magnetic coupler 420 that is coupled (e.g., mechanically coupled) to the mattress 402, and a second portion 440 (see FIGS. 4B-4D) of the magnetic coupler 420 that is coupled (e.g., mechanically coupled) to the foundation 404. The two major portions 430, 440 can be magnetically coupled together to attach the mattress 403 to the foundation 404. In some cases, the first portion 430 (and/or the second portion 440) of the magnetic coupler 420 can optionally include ergonomic features, such as gripping ribs 476, which will be discussed in greater detail in a subsequent section. In some cases, the first portion 430 (and/or the second portion 440) of the magnetic coupler 420 can optionally include apertures (e.g., slots 487 in FIGS. 4B and 4C) to facilitate mechanical fastening of one or more components of the magnetic coupler 420.

Figure 5A:
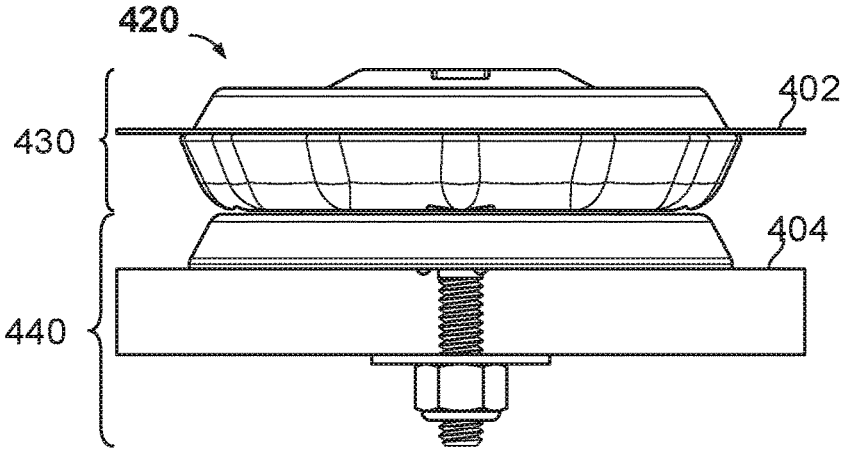
FIG. 5A is side view of the magnetic coupler as shown in FIG. 4A.
Figure 5B:
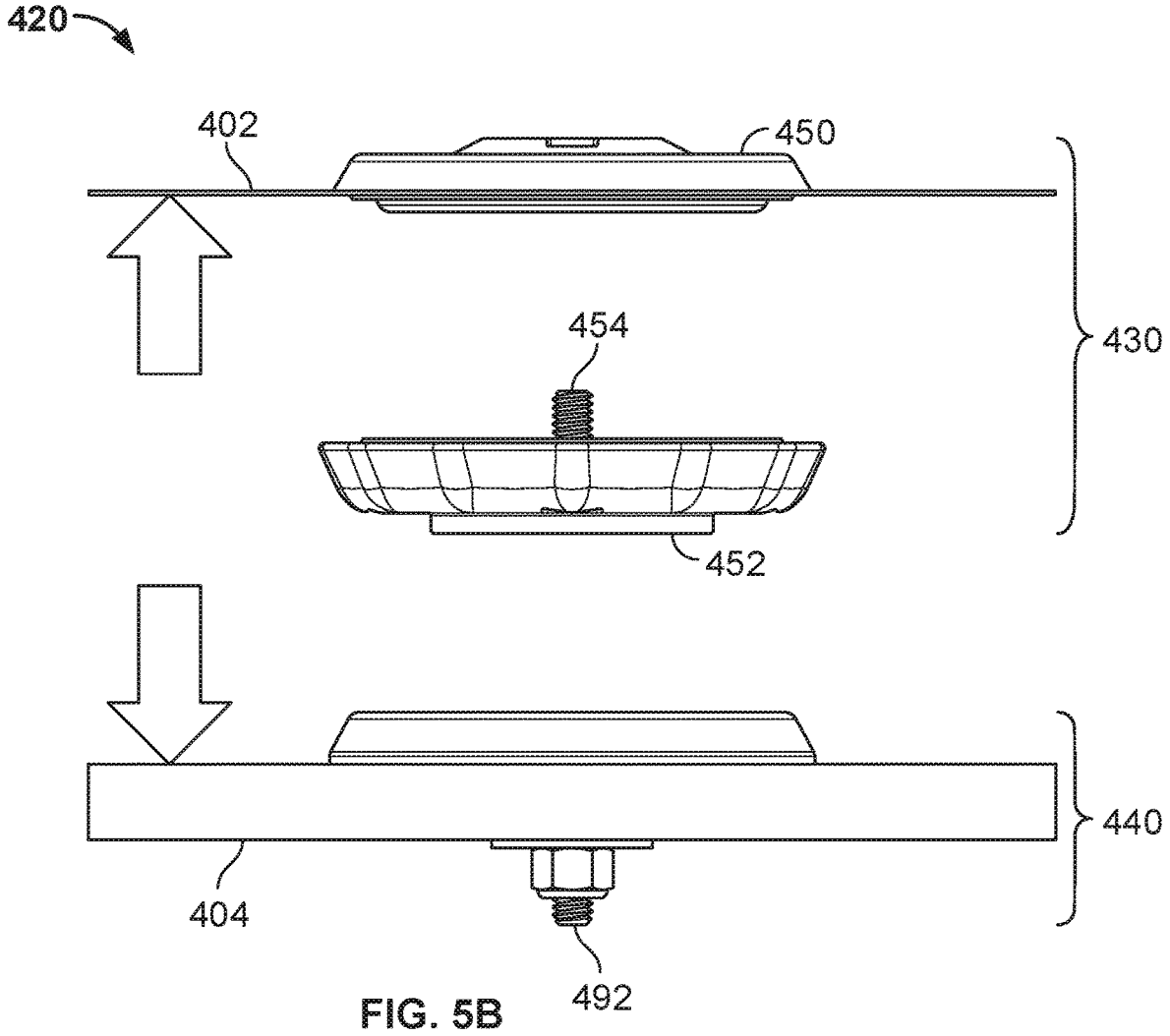
FIG. 5B is a partially exploded side view of the magnetic coupler of FIG. 4A.
Figure 5C:
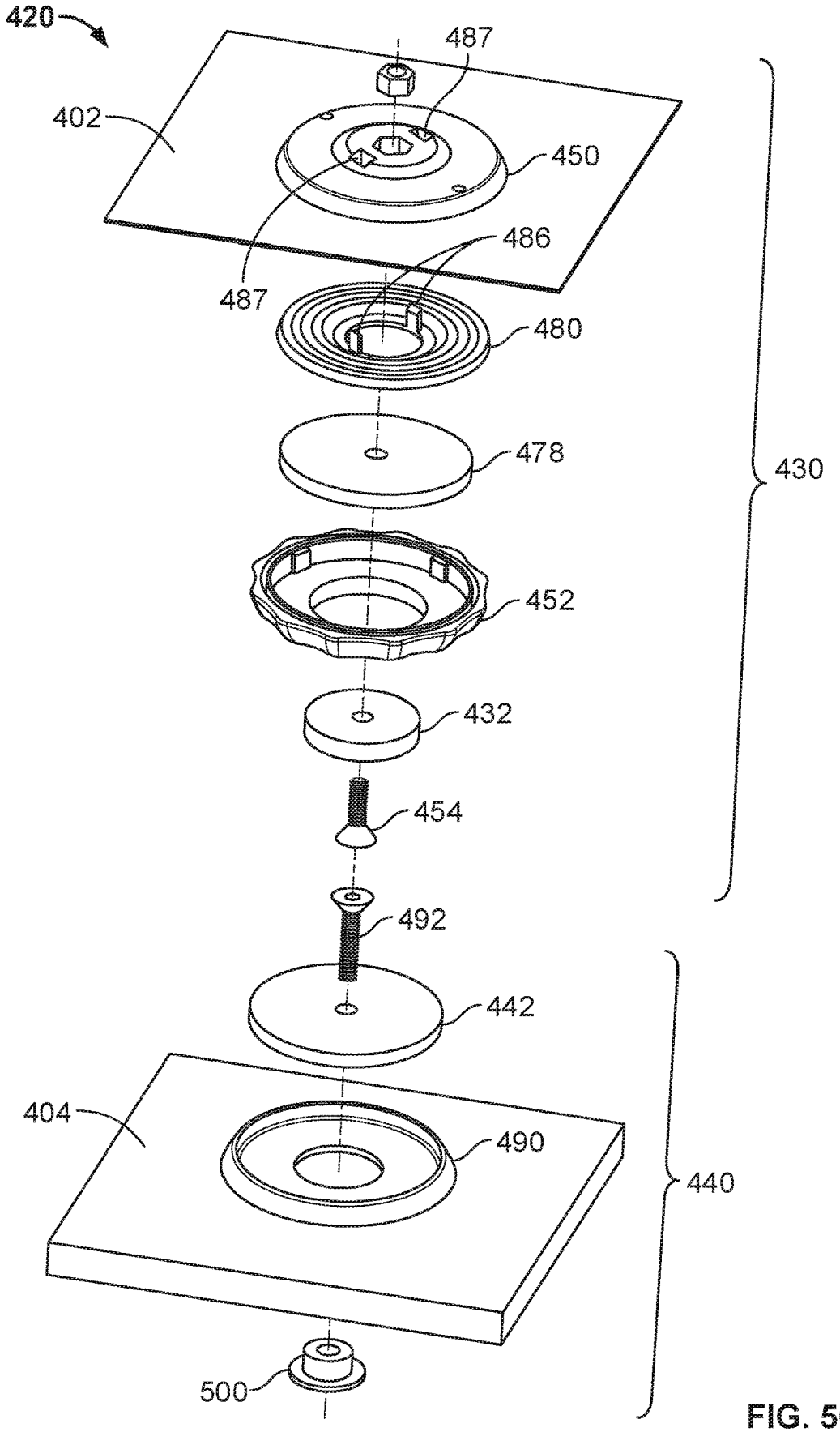
FIG. 5C is a fully exploded side perspective view of the magnetic coupler of FIG. 4A.
Figure 5D:
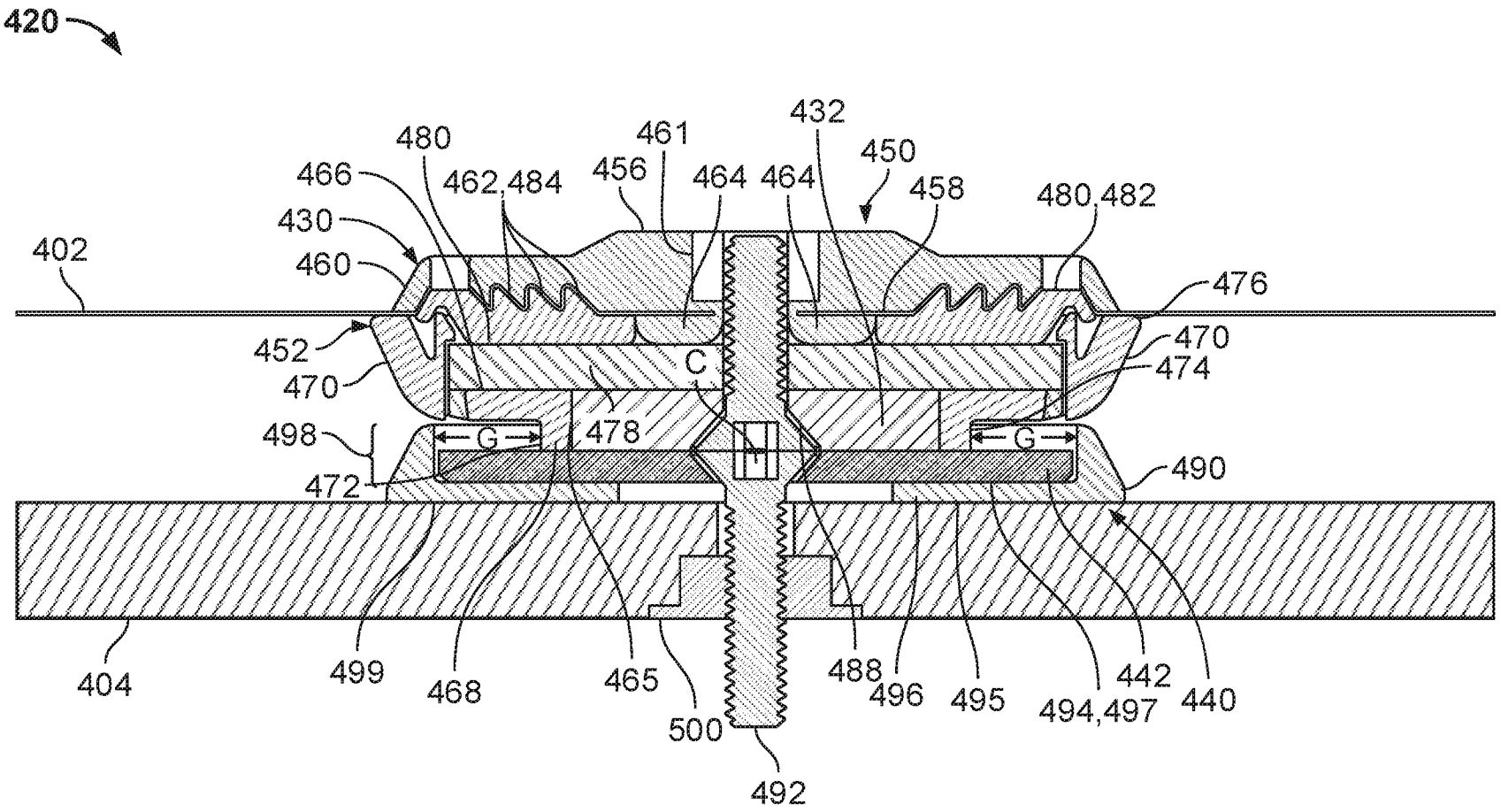
FIG. 5D is a cross-sectional side view of the magnetic coupler of FIG. 4A in an attached state.
Figure 5E:
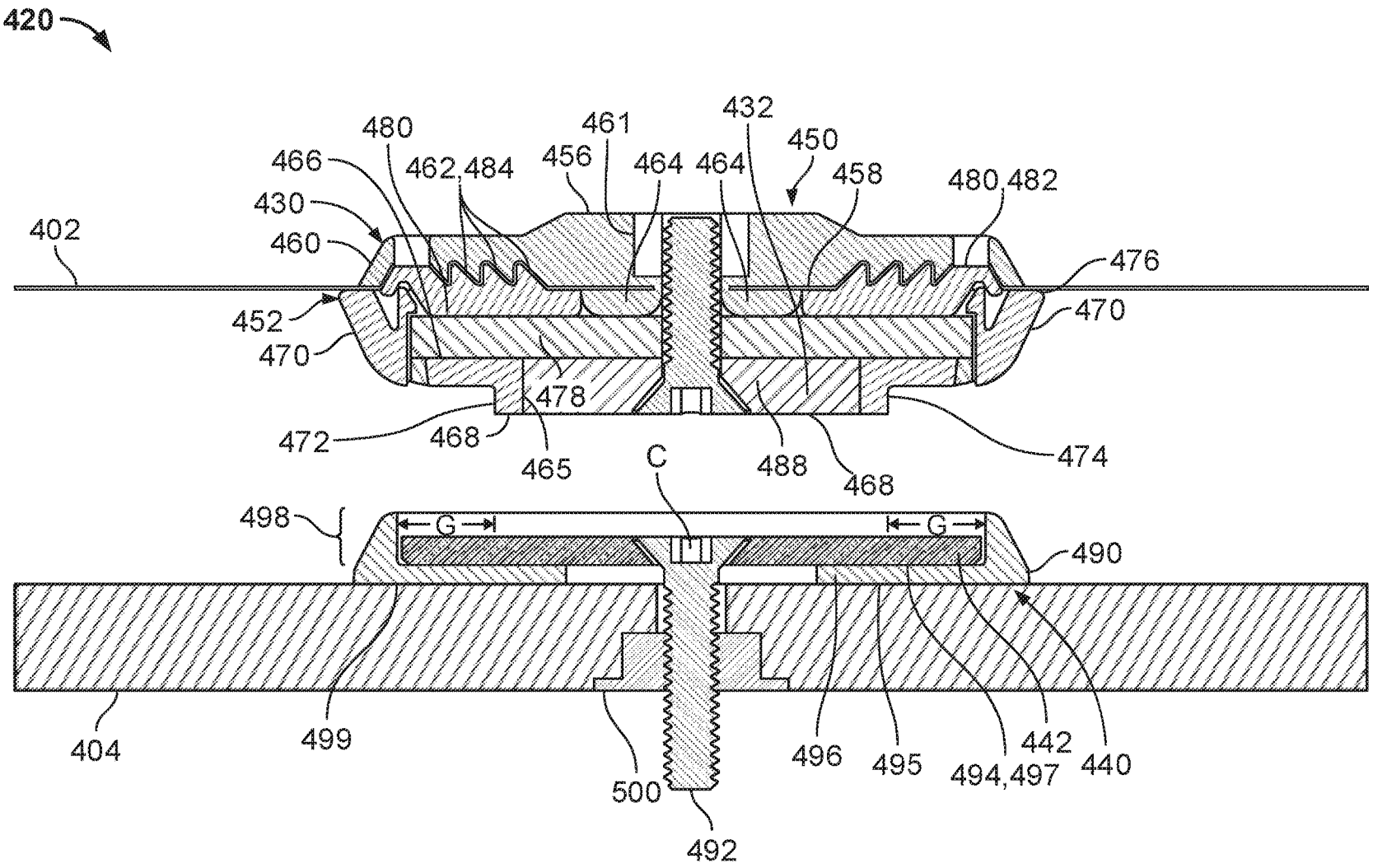
FIG. 5E is a partially exploded cross-sectional side view of the magnetic coupler of FIG. 4A in a detached state.

FIGS. 5A-5E show in greater detail the first and second portions of the magnetic coupler 420, which will be referred to hereinafter as a magnet assembly 430 and a target assembly 440, respectively. These figures show various views of the magnetic coupler 420 of FIGS. 5A-5E in an assembled state (FIGS. 5A, 5D) and an unassembled state (FIGS. 5B, 5C, and 5E).

As mentioned above, the magnetic coupler 420 can include the magnet assembly 430, which is magnetically coupleable to the target assembly 440. The magnet assembly 430 can be configured to secure one or more magnets 432 to a portion of the mattress 402 (e.g., the outer fabric layer of the mattress). A "magnet" is defined in this document as any material or object that produces a magnetic field. The magnet 432 can include any material containing iron (e.g., steel) that attracts other iron-containing objects or aligns itself in an external magnetic field. In some cases, the magnet 432 can include one or more permanent magnets (e.g., neodymium iron boron (NdFeB), samarium cobalt (SmCo), alnico, and ceramic or ferrite magnets), and/or electromagnets. In some cases, the magnet can be a cup magnet, e.g., a neodymium cup magnet supplied by Amazing Magnets. In some cases, the magnet can be a programmed magnet or correlated magnet, such as a Polymagnet® supplied by Polymagnet, which are engineered magnetic structures that incorporate correlated patterns of magnets with alternating polarity, designed to achieve a desired behavior. The magnet can be sized and shaped as desired. In some cases, the magnet 432 is sized and shaped to yield a desired magnetic field strength for securing the mattress 402 to the foundation 404. In some cases, the magnet 432 can be sized with a diameter ranging from about 1 inch to about 3 inches (e.g., about 1.00 inch, about 1.50 inches, about 1.75 inches, about 2.00 inches, about 2.25 inches, about 2.50 inches, or about 3.00 inches), and a thickness ranging from about 0.25 inches to about 1 inch (e.g., about 0.25 inches, about 0.50 inches, about 0.75 inches, or about 1.00 inches), or from about 0.10 inches to about 0.25 inches (e.g., about 0.10 inches, about 0.12 inches, about 0.14 inches, about 0.16 inches, about 0.18 inches, about 0.20 inches, about 0.22 inches, or about 0.25 inches).

Still referring to FIGS. 5A-5E, the target assembly 440 can be configured to secure one or more targets 442 to the foundation. A "target" is defined in this document as a ferrous material or other object that suitably responds to a magnetic field. Exemplary targets 442 can include, but are not limited to, iron, certain steels, nickel, cobalt, and alloys or combinations thereof. The target 442 is attracted to the magnet. The target 442 serves to attract and bond to the magnet 432 when placed in close proximity to the magnet 432. The target 442 can be sized and shaped as desired. In some cases, the target 442 is sized and shaped for coupling with the magnet 432. In some cases, the target 442 can be sized with a diameter ranging from about 2 inch to about 4 inches (e.g., about 2.00 inch, about 2.50 inches, about 2.75 inches, about 3.00 inches, about 3.25 inches, about 3.50 inches, 3.75 inches or about 4.00 inches), and a thickness ranging from about 0.05 inches to about 0.5 inch (e.g., about 0.05 inches, about 0.10 inches, about 0.20 inches, about 0.30 inches, about 0.40 inches, or about 0.50 inches).

The attraction between the magnet 432 in the magnet assembly 430 and the target 442 in the target assembly 440 can be used to form a bond, e.g., a magnetic coupling, when the magnet assembly 430 and the target assembly 440 are placed in close proximately to one another. As such, the magnetic coupler 420 can be used to secure the mattress 402 to the bed foundation 404 when the magnet assemblies 430 of the mattress 402 are placed near the target assemblies 440 of the foundation 440.

The various embodiments of this disclosure are not limited to only the depicted embodiments, however. For example, although not shown in FIGS. 5A-5E, in some cases, the magnet assemblies 430 can be configured to secure the magnet 432 to the foundation 404, and the target assemblies 440 can be configured to secure the target 442 to the mattress 402.

The bed systems provided herein (e.g., the bed system 100 of FIG. 1) can include one or more magnetic couplers 420 to secure the mattress 402 to the foundation 404 during normal use, e.g., when the user adjusts his or her sleep position on the mattress 402, or when the foundation 404 articulates, for example, the foundation 404 articulates from a sitting position to a sleeping position. As such, the bed system can include the one or more magnetic couplers 420 for securing the mattress 402 to the foundation 404 under conditions in which the forces (tensile and/or torque forces) applied to the mattress is below a predetermined threshold force value. The predetermined threshold force value can be set to a suitable threshold. For example, in some cases, the predetermined threshold force value can range from about 50 lbf. to about 150 lbf. (e.g., from about 60 lbf. to about 140 lbf, from about 70 lbf to about 130 lbf, from about 80 lbf to about 120 lbf, from about 90 lbf to about 110 lbf, from about 95 lbf to about 105 lbf, about 50 lbf, about 60 lbf, about 70 lbf, about 80 lbf, about 90 lbf, about 100 lbf, about 110 lbf, about 120 lbf, about 130 lbf, about 140 lbf, or about 150 lbf). The predetermined threshold force should set high enough such that the magnet and target assemblies 430,440 can remain coupled while the foundation 404 articulates, but low enough so that the decoupling of the magnet assembly 430 and the target assembly 440 does not become too difficult for the user or cause damage (e.g., tearing) to the mattress 402. In some cases, at least one magnetic coupler 420 can be set to a first predetermined threshold force value, and at least one magnetic coupler 420 can be set to a second one predetermined threshold force value. In such cases, the different threshold force values may be appropriate for different couplers 420 due to the varying forces being applied to different locations along the mattress 402. For example, one or more first couplers 420 at or near the midsection of the mattress may be set to a first predetermined threshold force value of about 120 lbf, while one or more second couplers at or near the head or foot section of the mattress are set to a second predetermined threshold force value of about 80 lbf.

In some cases, for example, the predetermined threshold force value can have a value suitable for securing the mattress 402 on the foundation 404 with the couplers 420 during normal use. However, when the couplers 420 are subjected to a force value greater than the predetermined threshold force, the components of the magnetic couplers 420 will release and allow the mattress 402 to detach from the foundation 404. The predetermined threshold force can be set such that easy detachment of the mattress 402 from the foundation 404 can be achieved during a non-normal use, for example, when the mattress 402 is pulled or jerked away from the foundation 404 for servicing or disassembly. Furthermore, the couplers 420 allow the mattress 402 to be released from the foundation 404 when the couplers 420 are subjected to a high amount of force that would otherwise normally damage or tear a mattress 402 rigidly attached to the foundation 404. As such, damage to the mattress can be prevented by using the magnetic couplers 420, which in turn can help to extend the use life of the bed system.

Still referring to FIGS. 5A-5E, the magnet assembly 430 includes a top housing 450, a bottom housing 452, and a housing fastener 454. As best shown in FIGS. 5D-5E, the top housing 450 is generally circular and has a top surface 456, a bottom surface 458, and sloped lateral walls 460. The top housing 450 also defines a central hole 461 configured for receiving the housing fastener 454. The top surface 456 has a generally flat profile to prevent the tearing or damaging of interior portions of the mattress 402 after its attachment. The bottom surface 458 is defined by the sloped lateral walls 460, a plurality of teeth 462, and a central flange 464. The plurality of teeth 462 can serve to retain a portion of the mattress 402, such as the outer fabric layer that encapsulates the support structure of the mattress 402. The central flange 464 can serve as a guide or a stop feature to help position the other inner components of the coupler 420, such as a clamping disk 480 or a shunt 478, which will be discussed in later sections.

Figure 4A:
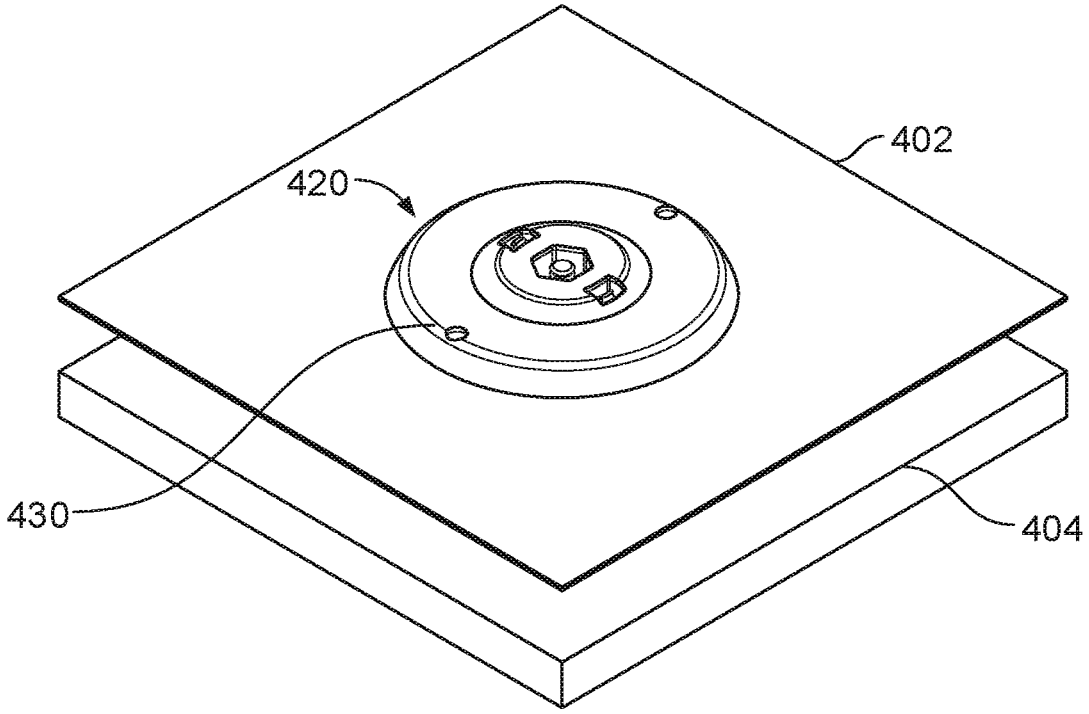
FIG. 4A is a perspective view of a magnetic coupler attached to a mattress and a foundation (shown as cut out portions in the illustration), according to an example.
Figure 4B:
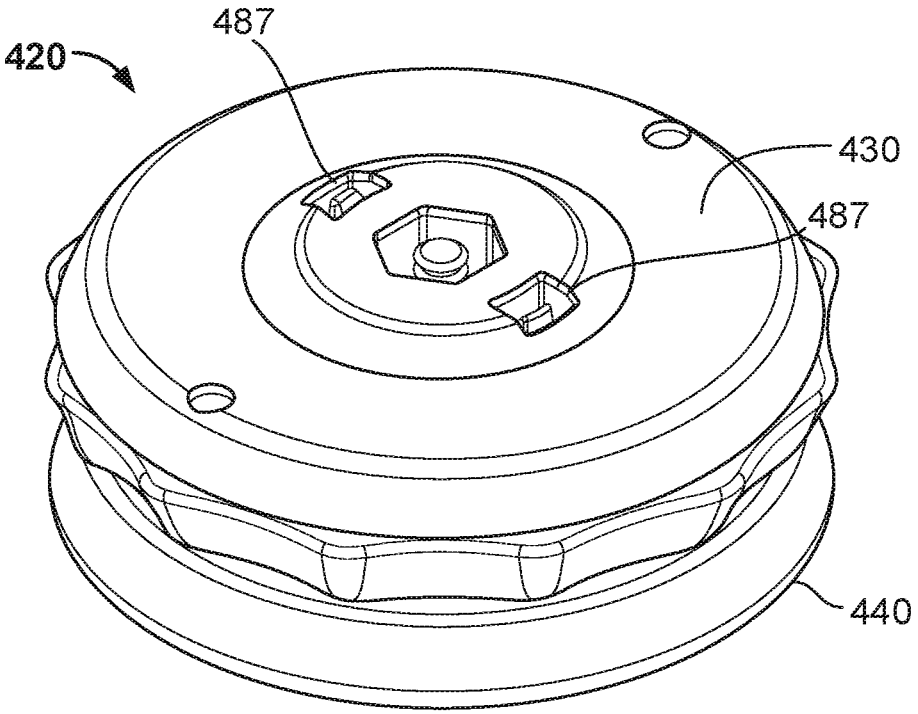
FIG. 4B is another perspective view of the magnetic coupler of FIG. 4A (with portions of the mattress and the foundation omitted for clarity).
Figure 4C:
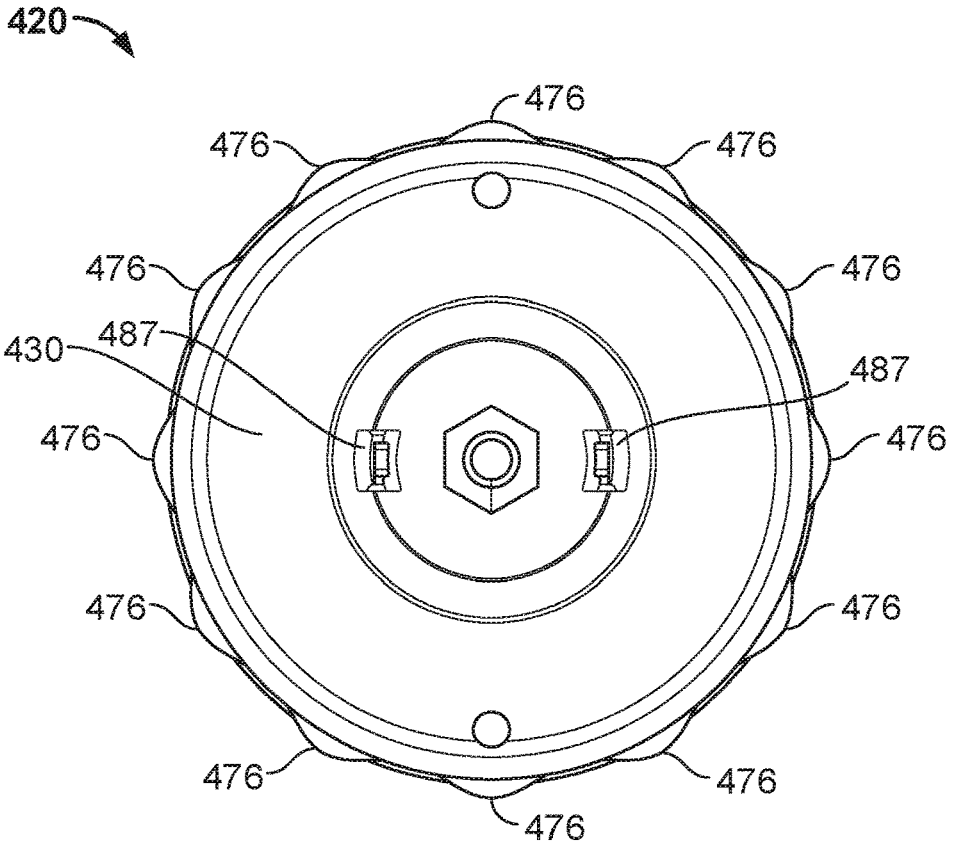
FIG. 4C is a top view of the magnetic coupler of FIG. 4A (with portions of the mattress and the foundation omitted for clarity).
Figure 4D:
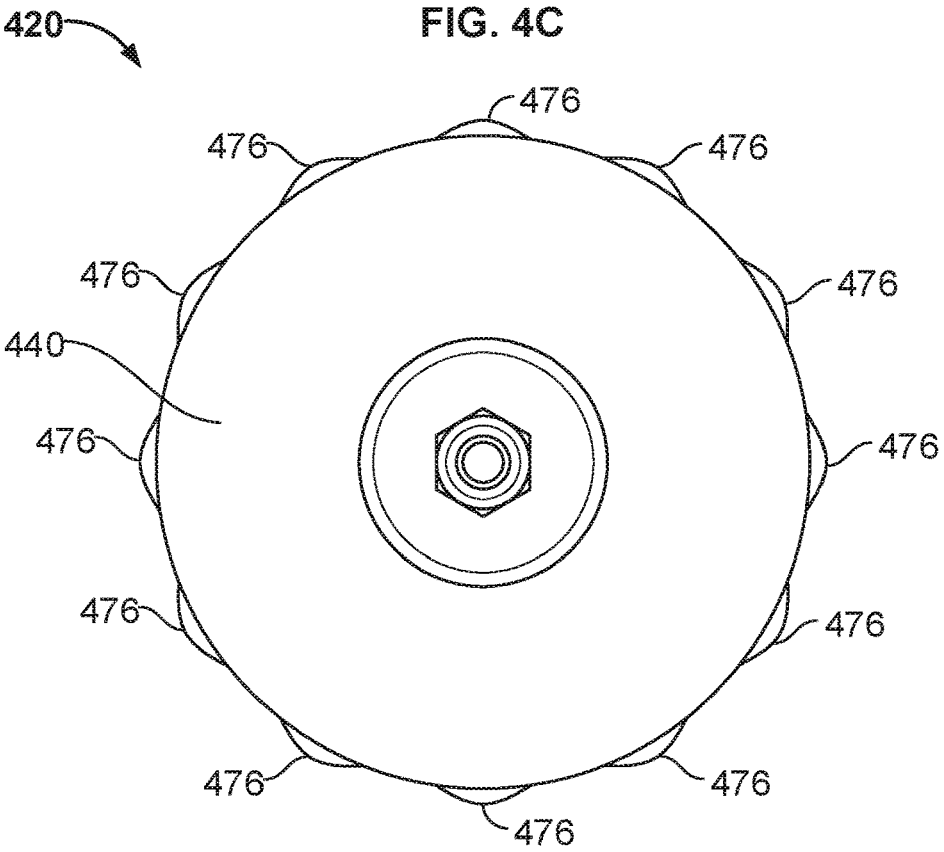
FIG. 4D is a bottom view of the magnetic coupler of FIG. 4A (with portions of the mattress and the foundation omitted for clarity).

As best shown in FIGS. 5D-5E, the bottom housing 452 of the magnet assembly 430 is a generally flat circular component with a central hole 465. The bottom housing 452 can include a top surface 466, a bottom surface 468, and sloped lateral walls 470. The top surface 466 can include a recessed inner cavity partially defined by interior surfaces of the sloped lateral walls 470. The bottom surface 468 includes an outwardly projecting bead 472 that forms a flange 474 that extends interior walls defining the central hole 465 of the bottom housing 452. The central hole 465 of the bottom housing 452 can be configured to receive the magnet 432. The exterior walls of the sloped lateral walls 470 of the bottom housing 452 can define a plurality of gripping ribs 476, which are best shown in FIGS. 4C and 4D. The gripping ribs 476 can be configured to assist a person with holding and manipulating the bottom housing 452 during the assembly or disassembly of the magnet assembly 430.

The top and bottom housing 450, 452 of the magnet assembly 430 can be configured to mate together to form a clam-shaped shell defining an internal cavity. The shell can be configured to hold various inner components within the internal cavity. For example, the internal cavity can hold one or more shunts 478 and a clamping disc 480, which will be discussed in later sections.

Both the top and bottom housing 450, 452 can include the centrally located holes 461, 465 sized for receiving the housing fastener 454 to secure the top and bottom housing 450, 452 together. The top and bottom housing 450, 452 can be secured together by the housing fastener 454, such as a threaded connector. In some cases, the fastener 454 can be a non-magnetic fastener, such as a stainless steel fastener, to assist with shielding or directing the magnetic field (which will be discussed further in later sections) generated by the magnet 432.

As best shown in FIGS. 5D-5E, the magnet assembly 430 can also include the clamping disc 480, the shunt 478, and the magnet 432. The clamping disc 480 can be a thin, disc-shaped component. The clamping disc 480 has a top surface 482 defined by a plurality of teeth 484. The plurality of teeth 484 extend circumferentially along the top planar surface 482 of the clamping disc 480. The plurality of teeth 484 can include two or more circumferentially extending teeth (e.g., three, four, five, or more than five teeth). Each tooth can have a triangular, trapezoidal, barb shaped, or the like. The teeth 484 of the clamping disc 480 engage with the complementary teeth 462 of the top housing 450, which were discussed above. The mated teeth 462, 484 when engaged with one another, are configured to grip a fabric material (e.g., the scrim of the mattress 402) to prevent slippage of the magnetic coupler 420 after being attached to the mattress 402. The mated teeth 462, 484 therefore provide the benefit of maintaining the proper location of the magnetic coupler 420 once attached to the mattress 402.

The clamping disc 480 can optionally include a pair of outwardly projecting prongs 486 (see FIG. 5C) from the top planar surface 482. Each prong 486 can include a tab configured for snap fitting the clamping disc 480 to the top housing 450 when each tab is inserted into a corresponding mating tab slot (e.g., the tab slots 487 in FIGS. 4B & 4C) defined in the top housing 450. The tab of the prong may be inserted through a premade hole in a portion of the mattress 402 (e.g., the outer fabric layer), or used to puncture through the portion of the mattress. The top housing 450 and the clamping disc 480 can be adapted to secure a portion of the mattress 402 therebetween when the clamping disc 480 is secured to the top housing 450. In some cases, the clamping disc 480 can include one or more prongs (e.g., one, two, three, four, five, or more than five prongs).

Still referring to FIGS. 5A-5E, the magnet assembly 430 includes a flat, circular magnet 432 disposed within a portion of the bottom housing 452. Although the depicted embodiment includes only one magnet 432, the magnet assembly 430 can include multiple magnets 432 to create a magnetic field for achieving magnetic coupling. As best shown in FIGS. 5D-5E, the magnet 432 can be sized and shaped to be received within the central hole 465 defined by the flange 474 of the bottom housing 452. The magnet 432 can also include a central bore 488 to receive the fastener 454 for securing the magnet 432 to the other components of the magnet assembly 430. In some cases, the fastener 454 can be used to prevent movement of the magnet 432 within the magnet assembly 430. In some cases, the magnet 432 can be sized and shaped for a press fit with the interior walls of the flange 474 of the bottom housing 452 as another means for securement.

As shown in FIGS. 5C-5E, the magnet assembly can optionally include a flat, circular shunt 478 disposed within the internal cavity of magnet assembly 430. The shunt 478 serves to shield magnetic field radiation generated by the magnet 432 from radiating in a particular direction. For example, the shunt 478 when placed on top of the magnet 432, will shield magnetic radiation generated from the magnet 432 from radiating towards the mattress 402 (see arrow in FIG. 5B) where the user would be located. In some cases, the shunt 478, when used in conjunction with the target 442 of the target assembly 440, can create a closed loop magnetic circuit. The closed loop magnetic circuit can localize and/or redirect the magnetic field to a desired location, for example, towards the bed foundation 404 and away from the mattress 402 (see arrow in FIG. 5B). Accordingly, the shunt 478 can therefore be used to redirect magnetic field in a desired direction, e.g., toward the foundation 404 (see arrow in FIG. 5B). The shunt 478 can therefore be beneficial in shielding or redirecting magnetic radiation away from the user on the mattress 402, in particular users who are sensitive to magnetic radiation (e.g., users with pacing implant devices).

The shunt 478 can be made of any ferrous material or object. Exemplary shunt materials can include, but are not limited to, iron, steel, nickel, cobalt, and alloys or combinations thereof. In some cases, the shunt 478 and the target 442 are made of the same materials. The shunt 478 can be any shape or size. In some cases, the shunt 478 can be shaped and sized to be received within the internal cavity of the magnet assembly 430, for example, between the clamping disc 480 and the bottom housing 452. The shunt 478 can also include a central bore to receive the fastener 454 for securing the components of the magnet assembly 430 together. In some cases, the shunt 478 is sized with a diameter and thickness for providing an adequate amount of magnetic shielding. In some cases, the shunt 478 can be sized with a diameter ranging from about 2 inch to about 4 inches (e.g., about 2.00 inch, about 2.50 inches, about 2.75 inches, about 3.00 inches, about 3.25 inches, about 3.50 inches, 3.75 inches or about 4.00 inches), and a thickness ranging from about 0.05 inches to about 0.5 inch (e.g., about 0.05 inches, about 0.10 inches, about 0.20 inches, about 0.30 inches, about 0.40 inches, or about 0.50 inches).

In some cases, all of the components of the magnet assembly 430 can be included as part of a kit (not shown) for the bed system such that the magnet assembly 430 can be attached during delivery and assembly of the bed system. In some cases, the magnet assembly 430 can be preassembled and attached to the mattress 402.

Still referring to FIGS. 5A-5E, the magnetic coupler includes a target assembly 440 that can be secured to the foundation 404 of the bed systems provided herein. Best shown in FIGS. 5D-5E, the target assembly 440 includes an annular cup 490, the target 442, and one or more mechanical fasteners 492, 500. As best shown in FIGS. 5D-5E, the annular cup 490 of the target assembly has a top surface 494, a bottom surface 495, and defines a central hole 496. The top surface 494 is defined by a raised ridge that extends along an outer edge of the annular cup 490 and a flat recessed annular surface 497 along a central portion of the cup 490 that forms a recessed area 498. The bottom surface 495 is a flat annular surface. The target 442 can be a flat disc sized to fit within the recessed area 498 of the cup 490 such that the target 442 does not shift or move significantly once placed on the recessed annular surface 497.

Referring to FIGS. 5A-5E, the cup 490 and the target 442 are coupled together by the threaded fastener 492 (e.g., bolt). A bottom surface of the target 442 can be bonded to the fastener 492 (e.g., a bolt head of a bolt) and secured to the cup 490 by a threaded tee nut 500 coupled to a shaft portion of the bolt extended through a central hole 496 of the cup 490. The threaded fastener 492 can also serve to couple the target assembly 440 to the foundation 404. In particular, the threaded fastener 492 can be extended through a bore in the foundation 404 and secured to the foundation 404 by a fastener 500, e.g., tee nut. There are various types of mechanical fasteners that can be used to couple the annular cup 490 to the target 442, and/or to generally couple the target assembly 440 to the foundation 404. Exemplary fasteners 492 can include, but are not limited to, a threaded fastener (e.g., a bolt, nut, tee nut, screw, washer, threaded insert, threaded rod, or the like), a grommet, a cable tie, a clasp, a clip, a latch, a pin, a rivet, a snap fastener, a staple, a strap, solder joint, and combinations thereof. In some cases, the target 442 can be press fit into, or bonded by a joinder (e.g., an adhesive or a solder) to the annular cup 490.

As best shown in FIGS. 5D-5E, the thickness of the target 442 is less than the height of the recessed area 498 such that a shallow recessed area 498 is still present after the placement of the target 442 within the recessed area 498 (best shown in cross-sectional views provided in FIGS. 5D-5E). The cup 490 is therefore configured to receive a bottom portion (e.g., bottom housing 452) of the magnet assembly 430 within the recessed area 498 when the magnet and target assemblies 430, 440 are joined.

When coupling, the bottom housing 452 of the magnet assembly 430 is placed in the recessed area 498 of the target assembly 440, which contain the target 442 (as best shown in FIGS. 5D and 5E). The bottom housing 452 of the magnet assembly 430 has the magnet 432 exposed along its bottom surface 468 and the recessed area 498 of the target assembly 440 has the target 442 exposed along its recessed annular surface 497, which together facilitate close magnet-to-target coupling when the magnet and target assemblies 430, 440 are joined. In some cases, the magnet 432 can be exposed along the bottom surface 468 of the magnet assembly 430 but positioned within the flange 474 such that a bottom surface of the magnet 432 is slightly recessed within the flange 474. The magnet 432 can thus be positioned within the flange 474 at a predetermined distance from the bottom surface 468 of the bottom housing. Positioning the magnet 432 the set predetermined distance from the bottom surface 468 can protect the magnet from impact forces that might otherwise damage the magnet 432 when the magnet assembly 430 and the target assembly are joined together. The predetermined distance should set large enough so that the magnet is protected from impact forces, but small enough so that the magnet assembly 430 magnetically couples to the target assembly 440 with a desired coupling force. The bottom surface of the magnet 432 can be set at a predetermined distance from the bottom surface of the bottom housing 452 such that the distance between the magnet 432 and the target ranges from about 0.001 inches to about 0.013 inches when the magnet and target assemblies are coupled together.

The magnet coupler 420 can be designed to allow for a small amount of imprecise positioning of the magnet and target assemblies 430, 440 that still achieves magnetic coupling therebetween. In particular, in some cases, the magnetic coupler 420 can be designed such that the surface area of the receiving portion of the target assembly is larger than the surface area of the received portion of the magnet assembly. This allows for the received portion of the magnet assembly 430 to be magnetically coupled to the receiving portion of the target assembly 440 even though the magnet assembly 430 can be offset from the center "C" of the target assembly, and thus not concentrically coupled to the target assembly 440. For example, as shown in FIGS. 5D and 5E, magnet assembly 430 can have a received portion (e.g., the flange 474 and the magnet 432 at the bottom surface 468) configured for securing the magnet 432 and seating within the receiving portion (e.g., the recessed annular surface 497 of the recessed area 498) of the target assembly 440. The surface area of the receiving portion of the magnet assembly 430, as shown, can be smaller than that of the receiving portion of the target assembly 440 to allow for offset coupling of the magnet and target assemblies. The difference in the surface areas of the received and receiving portions can be set, as desired, to form a coupling gap "G" that extends from an outer edge of the received portion to an inner edge of the receiving portion. In some cases, the ratio of the diameter of the receiving portion and the received portion can range from about 1.5:1 to 2:1, or from about 1.5 to 3:1, or from about 2:1 to 4:1. In some cases, the ratio of the surface area of the receiving portion to the received portion can range from about 2:1 to 5:1 (e.g., from about 2:1 to 3:1, from about 2:1 to 4:1, from about 3:1 to 4:1, from about 3:1 to 5:1, or from about 4:1 to 5:1). In some cases, a maximum coupling gap G between the receiving portion to the received portion can range from about 0.05 inches to about 0.1 inches (or about 1.27 mm to about 2.54 mm), or from about 0.1 inches to about 1.0 inch (or from about 2.54 mm to about 25.4 mm).

In some cases, the target assembly 440 can be included as part of a kit (not shown) for the bed system such that the target assembly 440 can be attached during delivery and assembly of the bed system. In some cases, the target assembly 440 can be preassembled to the bed foundation 404 prior to delivery.

Figure 6A:
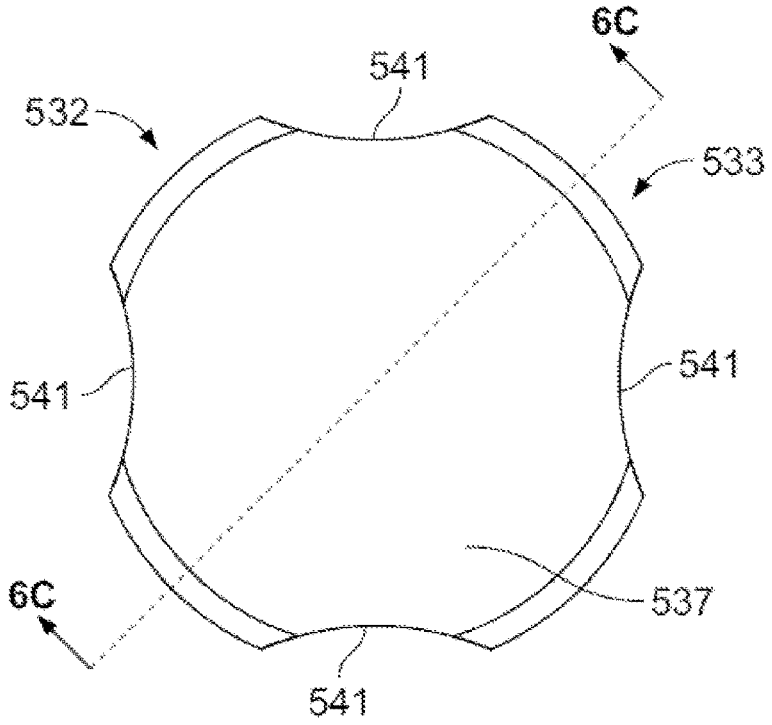
FIG. 6A is bottom view of a magnet subassembly.
Figure 6B:
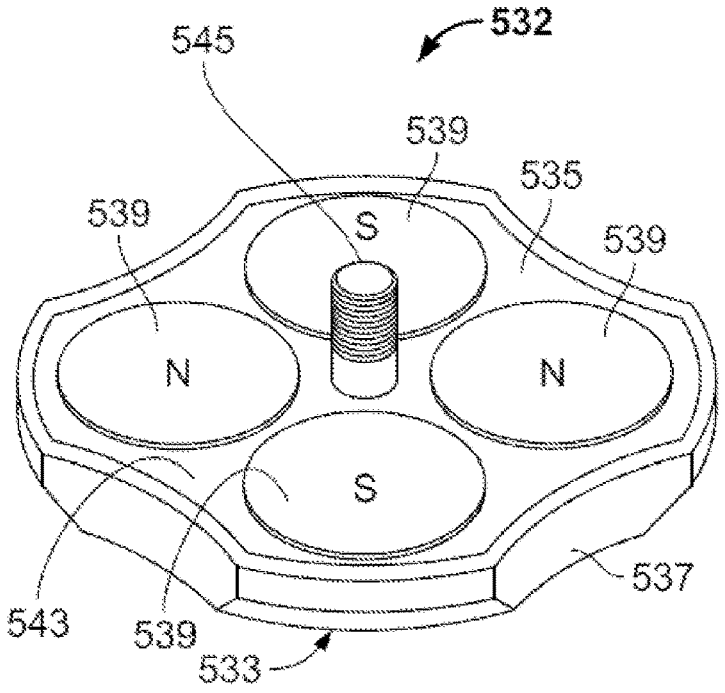
FIG. 6B is perspective view of the magnetic subassembly as shown in FIG. 6A.

Referring to FIGS. 6A-6D, certain embodiments of the magnet assembly provided herein can include a magnet subassembly 532 as shown. The depicted magnet subassembly 532 has a body 533 that includes a shunt 535, a cover 537, and multiple discrete magnets 539 housed between the shunt 535 and the cover 537. In some embodiments, the magnet subassembly 532 can be shaped in any desired size and form (e.g., including various geometric cross-sectional shapes such as a rectangular, square, hexagonal, circular, oval, triangular shape, or irregular shapes). In various embodiments, the body 533 of the magnet subassembly 532 can include grip enhancing features along its side edges to allow for improved ease of handling. For example, as best shown in FIGS. 6A and 6B, in some embodiments, the magnet subassembly 532 can include four radiused (concave) features 541 along its side edge to facilitate easy gripping.

Figure 6C:
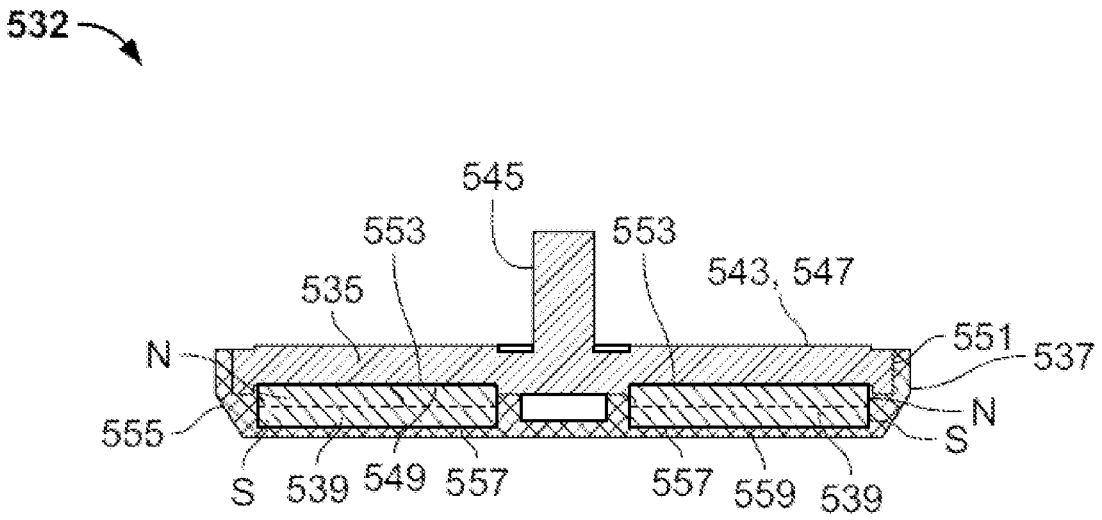
FIG. 6C is side view of the magnetic subassembly as shown in FIG. 6A.
Figure 6D:
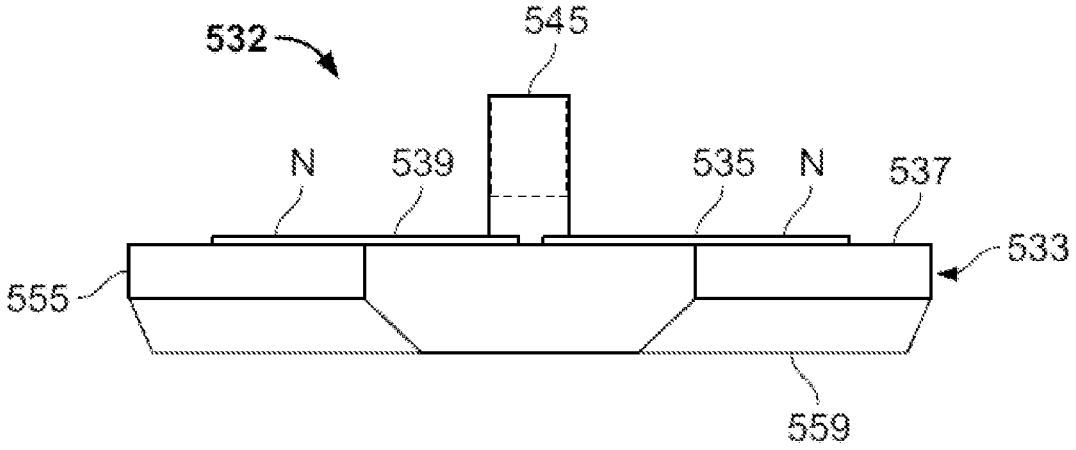
FIG. 6D is a cross-sectional side view of the magnetic subassembly as shown in FIG. 6A.

The shunt 535 can include a washer portion 543 and a rod portion 545 that extends transversely from the washer portion 543. The washer portion 543 can be a thin component (approximately 0.1 inches) that includes top and bottom planar surfaces 547, 549, and side surfaces 551. The top planar surface 547 can be configured to mate the shunt 535 with other components within the magnet assemblies provided herein. The bottom planar surface 549 of the shunt 535 can be configured to couple with the discrete magnets 539. The side surfaces 551 can engage with the cover 537. The shunt 535, in some embodiments, can be shaped and sized to be partially or fully received within the cover 537. In some embodiments, as best shown in FIG. 6C, the shunt 535 can include recessed portions 553 along the bottom planar surface 547 for receiving the magnet elements. The rod portion 545 can be integrally coupled or fastened to the washer portion 543. The rod portion 545 can be partially or fully threaded to couple the magnet subassembly 532 to a magnet assembly and/or a portion of a mattress (e.g., an underside of the mattress). The shunt 535 can be made of any ferrous material (e.g., steel) provided herein. The shunt 535 can be used to couple directly to the discrete magnets 539, provide a top housing for the magnet subassembly 532, and/or fasten the magnet subassembly 532 to a mattress and/or a magnet coupler.

The cover 537 of the magnet subassembly 532 can be a cup-shaped body that includes lateral walls 555 extending to define a recessed portion 557 configured to receive the magnets 539 and at least a portion of the shunt 535, and an exterior bottom surface 559 that mates with components within the magnet couplers provided herein. In some embodiments, the cover 537 can include multiple lower recessed portions 557, each configured for receiving a magnet 539. The cover 537 can be configured as a magnet spacer that sets a desired distance between each of the magnets 539 to desirably adjust (e.g., increase or decrease) a total magnetic field of the magnet subassembly 532 and/or to improve ease of assembly. The cover 537 can include a top portion for receiving the shunt such that the magnets 539 are contained within the shunt 535 and the cover 537. The exterior bottom surface 559 of the cover 537 can optionally include labeling to facilitate proper identification of the part during its assembly or disassembly. In various embodiments, the cover 537 can be made a plastic material, or any non-ferrous material.

Still referring to FIGS. 6A-6D, the magnet subassembly 532 can include an array of discrete magnets 539, e.g., four magnets, arranged with an alternating polarity pattern. In some embodiments, the array of magnets 539 can be arranged in any desired pattern, e.g., any geometric pattern such as a circular pattern, or any irregular pattern. In some embodiments, the array of magnets 539 can be arranged with alternating polarities, or with unidirectional polarities. For example, as shown in FIGS. 6B and 6C, each magnet 539 in the magnet subassembly 532 can be positioned near one or more adjacent magnets 539 having an opposite polarity (e.g., north poles (N) and south poles (S) are directed in an opposite directions in an alternating pattern). Each magnet 539 can be disc shaped. Each magnet 539 can have a thickness of about 0.125 inches.

The magnet subassembly 532 can be designed to generate a desired magnetic field for the magnetic couplers provided herein to couple a mattress to a frame, without causing any magnetic field interference with other objects (e.g., metal objects placed on or near the mattress). The design of the magnet subassembly 532 can be configured to reduce or eliminate potential magnetic field interference caused by the magnet subassembly 532, in some embodiments. For example, the polarity pattern, the distance between the discrete magnets 539, and/or size and shape of the magnets 539 and/or shunt (e.g., shunt 535) can be configured to adjust (e.g., minimize) the magnetic field generated by the magnet subassembly 532. In some embodiments, the multiple magnetic poles generated by individual magnets 539 within the magnet subassembly 532 can be configured to provide a compact magnetic field. In some embodiments, the polarity of the individual magnets 539 arranged in an alternating pattern can provide a compact magnetic field that allows for coupling capabilities with minimal or no interference with other proximate objects. In some embodiments, the array of separate, discrete magnets 539 within the subassembly 532, in which each magnet 539 has its own polarity, can selectively direct magnetic energy, and/or selectively or fully reduce (or increase) the magnetic field generated by the magnet subassembly 532. Such advantages can be important since a magnetic field generated by the magnet subassembly 532 can have a potential to interfere with certain medical devices (e.g., pacemakers) or systems.

As described above and shown in the figures, bed systems can include a magnetic coupler that can provide convenient attachment and detachment of two bed components, e.g., mattress and the foundation. Such bed systems can include one or more magnetic couplers that can significantly reduce the time and inconvenience of installing a bed system and disassembling a bed system, while providing secure attachment of a mattress that provides user comfort and sleep quality to the bed foundation during normal use.

A number of embodiments of the inventions have been described. Nevertheless, it will be understood that various modifications can be made without departing from the spirit and scope of the invention. For example, in some embodiments the bed need not include adjustable air chambers. Additionally, different aspects of the different embodiments of foundations, mattresses, and other bed system components described above can be combined while other aspects as suitable for the application. Accordingly, other embodiments are within the scope of the following claims.

What is claimed is:

1. A bed system, comprising:

a foundation system comprising:

an articulable head section having a head section top surface configured for supporting a head portion of a mattress;

a first midsection having a midsection top surface configured for supporting a middle portion of the mattress; and an articulable foot section having a foot section top surface configured for supporting a foot portion of the mattress;

a left foundation comprising left head, middle, and foot platforms, wherein the left head platform forms part of the articulable head section, the left middle platform forms part of the first midsection, and the left foot platform forms part of the articulable foot section; and a right foundation comprising right head, middle, and foot platforms, wherein the right head platform forms part of the articulable head section, the right middle platform forms part of the first midsection, and the right foot platform forms part of the articulable foot section;

first and second midsection magnets coupled to the midsection top surface, wherein the first midsection magnet is coupled to the left middle platform at the first midsection proximate a left outer edge of the left middle platform and wherein the second midsection magnet is coupled to the right middle platform at the first midsection proximate a right outer edge of the right middle platform and wherein the left and right middle platforms have the first and second midsection magnets only proximate the left and right outer edges of the left and right middle platforms;

first and second foot section magnets coupled to the foot section top surface, wherein the first foot section magnet is coupled to the left foot platform at the articulable foot section proximate a left outer edge of the left foot platform and wherein the second foot section magnet is coupled to the right foot platform at the articulable foot section proximate a right outer edge of the right foot platform and wherein the left and right foot platforms have the first and second foot section magnets only proximate the left and right outer edges of the left and right foot platforms; and first and second head section magnets, wherein the first head section magnet is coupled to the articulable head section proximate a foundation middle and wherein the second head section magnet is coupled to the articulable head section proximate the foundation middle, wherein the first and second midsection magnets, the first and second foot section magnets, and the first and second head section magnets are part of a set of magnetic couplers, wherein the set of magnetic couplers consists of six magnetic couplers.

2. The bed system of claim 1, wherein the foundation system further comprises:

a second midsection having a second midsection top surface configured for supporting the middle portion of the mattress, wherein the second midsection is connected between the first midsection and the articulable foot section, and wherein no magnets are positioned on the second midsection top surface.

3. The bed system of claim 1, wherein the foundation system includes a plurality of targets that connect the foundation system to the first and second midsection magnets and the first and second foot section magnets, wherein the bed system further comprises:

the mattress, wherein the mattress defines a mattress top surface and a mattress bottom surface, wherein the mattress includes the first and second midsection magnets and the first and second foot section magnets.

4. The bed system of claim 1, wherein the first head section magnet is coupled to the articulable head section proximate an inner edge of the left head platform and wherein the second head section magnet is coupled to the articulable head section proximate an inner edge of the right head platform.

5. The bed system of claim 1, wherein the first midsection magnet is a first discrete magnet that is part of a midsection magnet subassembly, wherein the midsection magnet subassembly further comprises second, third, and fourth discrete magnets, wherein the first and third discrete magnets are aligned with south poles facing the midsection top surface and with north poles facing away from the midsection top surface, wherein the second and fourth discrete magnets are aligned with north poles facing the midsection top surface and with south poles facing away from the midsection top surface, wherein the second discrete magnet is positioned between the first and third discrete magnets, and wherein the third discrete magnet is positioned between the second and fourth discrete magnets.

6. The bed system of claim 5, wherein the midsection magnet subassembly further comprises a metal shunt.

7. A bed system, comprising:

a foundation system comprising:

a left foundation comprising left head, middle, and foot platforms that define a left foundation outer edge and a left foundation inner edge;

a right foundation comprising right head, middle, and foot platforms that define a right foundation outer edge and a right foundation inner edge, wherein the right foundation is configured to be positioned next to the left foundation with the left foundation inner edge adjacent to the right foundation inner edge;

first and second midsection mattress couplers, wherein the first midsection mattress coupler is coupled to the left middle platform proximate the left foundation outer edge and wherein the second midsection mattress coupler is coupled to the right middle platform proximate the right foundation outer edge;

first and second foot section mattress couplers, wherein the first foot section mattress coupler is coupled to the left foot platform proximate the left foundation outer edge and wherein the second foot section mattress coupler is coupled to the right foot platform proximate the right foundation outer edge; and first and second head section mattress couplers, wherein the first head section mattress coupler is coupled to the left head platform proximate the left foundation inner edge and wherein the second head section mattress coupler is coupled to the right head platform proximate the right foundation inner edge, wherein the left and right head platforms comprise only mattress couplers on the left and right head platforms that are proximate the inner edges of the left and right head platforms, wherein the first and second midsection mattress couplers, the first and second foot section mattress couplers, and the first and second head section mattress couplers are part of a set of magnetic couplers, wherein the set of magnetic couplers consists of six magnetic couplers.

8. The bed system of claim 7, wherein the first midsection mattress coupler comprises four discrete magnets aligned with alternating polarity.

9. The bed system of claim 7, wherein the left foundation further comprises a left second middle platform having no mattress couplers and the right foundation further comprises a right second middle platform having no mattress couplers.

10. The bed system of claim 7, and further comprising:

a mattress that defines a mattress top surface and a mattress bottom surface, wherein the mattress is connected to the first and second midsection mattress couplers, the first and second foot section mattress couplers, and the first and second head section mattress couplers, wherein the mattress includes a split head section.

11. The bed system of claim 7, and further comprising:

a first articulable mattress that defines a first mattress top surface and a first mattress bottom surface, wherein the first articulable mattress is connected to the first midsection mattress coupler, the first foot section mattress coupler, and the first head section mattress coupler; and a second articulable mattress that defines a second mattress top surface and a second mattress bottom surface, wherein the second articulable mattress is connected to the second midsection mattress coupler, the second foot section mattress coupler, and the second head section mattress coupler.

12. The bed system of claim 1, wherein the first and second head section magnets are located only on a central portion of the articulable head section.

13. The bed system of claim 12, wherein the first and second head section magnets are attached to the articulable head section closer to one another than either the first and second midsection magnets or the first and second foot section magnets.

14. The bed system of claim 12, wherein the first and second midsection magnets are spaced apart by a first lateral distance D2 and the first and second head section magnets are spaced a second lateral distance D1, wherein D1 is less than D2.

* * * * *